US012054325B2

(12) United States Patent
Koretz et al.

(10) Patent No.: US 12,054,325 B2
(45) Date of Patent: Aug. 6, 2024

(54) RESEALABLE CONTAINER ADAPTER

(71) Applicant: C&A IP Holdings, LLC, Edison, NJ (US)

(72) Inventors: David Andrew Koretz, Miami, FL (US); David Henry Caldwell Karl, Fort Lauderdale, FL (US); Travis Ronald Coleman, Sunrise, FL (US); Raul Eugene Chinda, Fort Lauderdale, FL (US)

(73) Assignee: C&AIP Holdings, LLC, Edison, NJ (US)

( * ) Notice: Subject to any disclaimer, the term of this patent is extended or adjusted under 35 U.S.C. 154(b) by 510 days.

(21) Appl. No.: 17/271,922

(22) PCT Filed: Sep. 12, 2019

(86) PCT No.: PCT/US2019/050752

§ 371 (c)(1),
(2) Date: Feb. 26, 2021

(87) PCT Pub. No.: WO2020/056092

PCT Pub. Date: Mar. 19, 2020

(65) Prior Publication Data

US 2021/0316915 A1 Oct. 14, 2021

Related U.S. Application Data

(60) Provisional application No. 62/731,534, filed on Sep. 14, 2018.

(51) Int. Cl.

*B65D 51/00* (2006.01)
*B65D 41/00* (2006.01)
*B65D 47/36* (2006.01)
*B65D 81/18* (2006.01)

(52) U.S. Cl.

CPC ..... *B65D 51/002* (2013.01); *B65D 41/005* (2013.01); *B65D 47/36* (2013.01); *B65D 81/18* (2013.01)

(58) Field of Classification Search

CPC .... B65D 81/24; B65D 81/2076; B65D 81/18; B65D 77/067; B65D 51/002; B65D 47/36; B65D 41/62; B65D 41/005; B65D 39/0052; B65D 1/18; B65D 1/32; B65D 47/2031; B65D 53/00; B67D 1/001; B67D 1/1279

USPC ..... 215/247; 222/542

See application file for complete search history.

(56) References Cited

U.S. PATENT DOCUMENTS

2007/0023430 A1* 2/2007 Seher ..... A61J 1/1406 137/800
2022/0297901 A1* 9/2022 Kieras ..... B65D 77/067

FOREIGN PATENT DOCUMENTS

EP 2105103 A1 * 9/2009 ..... A61B 17/00491

* cited by examiner

*Primary Examiner* — John K Fristoe, Jr.
*Assistant Examiner* — Madison L Poos
(74) *Attorney, Agent, or Firm* — Leason Ellis LLP

(57) ABSTRACT

A container adapter includes a first chamber. The first chamber is adapted to attach to a container. The container further includes a second chamber. The second chamber includes a sealing surface and a resealable interface disposed between the first chamber and the second chamber. The second chamber is exposed to an ambient environment.

15 Claims, 28 Drawing Sheets

RESEALABLE CONTAINER ADAPTER

CROSS REFERENCE TO RELATED APPLICATION

This application claims priority to PCT Application No. PCT/US2019/050752 titled "RESEALABLE CONTAINER ADAPTER" and filed on Sep. 12, 2019; which claims priority to U.S. Provisional Application No. 62/731,534 titled "RESEALABLE CONTAINER ADAPTER" and filed on Sep. 14, 2018. Both of these applications are incorporated by reference in their entirety.

BACKGROUND

Liquids may be transported and/or stored in containers. Each container may include a single or multiple servings of a liquid. Each container may maintain a quality of the liquid disposed in each container during transport and/or storage. The container may maintain the quality of the liquid by preventing oxidation or other chemical reactions from occurring while the liquid is transported and/or stored.

The container may include a seal that may be opened to remove portions of the liquid from the container. Opening the seal may expose the liquid in the container to an environment near the container.

SUMMARY

In one aspect, a container adapter in accordance with one or more embodiments of the invention includes a first chamber adapted to attach to a container; a second chamber comprising a sealing surface; and a resealable interface disposed between the first chamber and the second chamber, the second chamber is exposed to an ambient environment.

In one aspect, a system in accordance with one or more embodiments of the invention includes a container adapter that is adapted to attach to a container; and a container seal remover that is adapted to remove a container seal of the container while maintaining a seal between the container adapter and the container.

In one aspect, a container seal remover in accordance with one or more embodiments of the invention includes a seal remover adapted to remove a seal of a container while the container seal remover is attached to a container adapter; a housing including: a sealed compartment, and a sealing surface that isolates the sealed compartment from an ambient environment while the seal remover removes the seal of the container.

In one aspect, a system in accordance with one or more embodiments of the invention includes a container adapter adapted to attach to a container; and an appliance adapted to dispense fluid from the container using the container adapter.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Figure 1A:
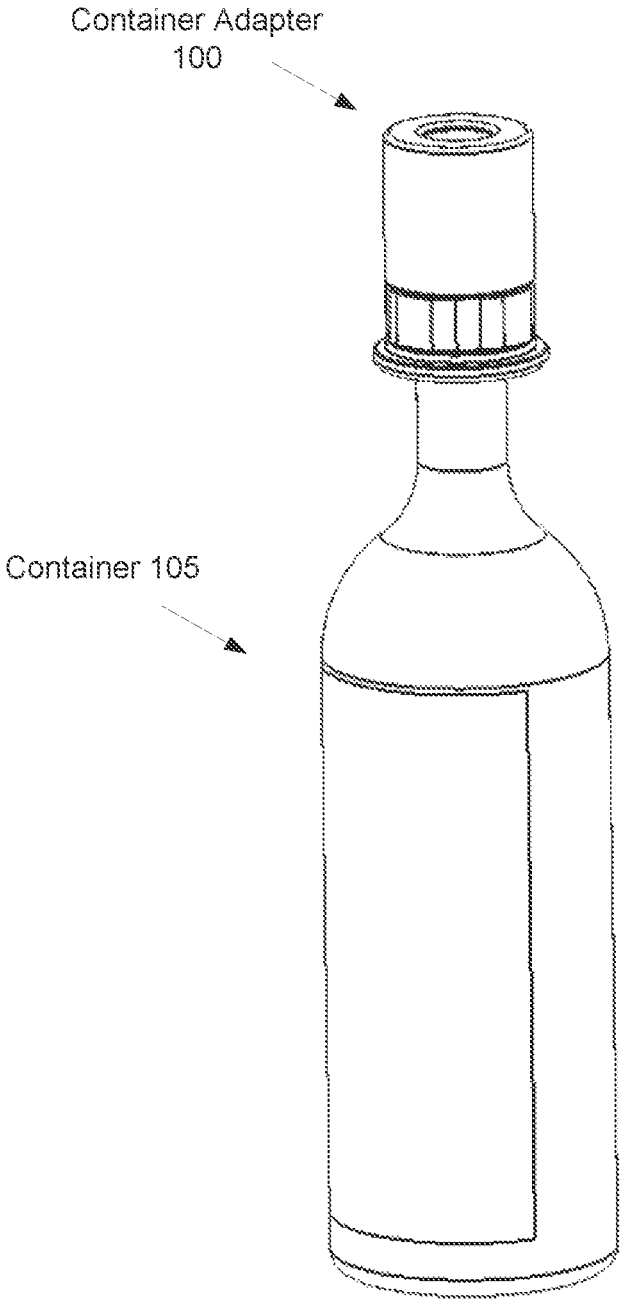
FIG. 1A shows an isometric diagram of a container adapter disposed on a container accordance with one or more embodiments of the invention.

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid obscuring the description.

In the following description of the figures, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment, which may be implemented in addition to, in conjunction with, or in place of the embodiments described with regard to a corresponding like-named component in any other figure.

In general, embodiments of the invention relate to systems, devices, and methods for dispensing fluids. More specifically, the systems, devices, and methods may enable a portion of a fluid to be dispensed from a container while preserving the fluid remaining in the container.

In one or more embodiments of the invention, a container adapter may be used to dispense fluid from a container while preserving the fluid remaining in the container. The container adapter may be a physical device that includes an interface. The interface may be reversibly unsealed, i.e., a resealable interface. When the interface is unsealed, fluid in the container may be dispensed. When the interface is sealed, fluid in the container may be preserved by preventing air, or other materials, from the environment surrounding the container from interacting with the fluid in the container.

In one or more embodiments of the invention, the resealable interface may be implemented as a valve. The valve may have a resting position, i.e., when forces are not being applied to the valve, that seals the valve. The valve may be, for example, a one-way valve, an iris valve, a duckbill valve, or a flap valve. The valve may be other types of valves without departing from the invention.

In one or more embodiments of the invention, the container adapter may be reversibly attached to a container. The container adapter may be attached to the container at a position on the container that is adjacent to a container seal of the container. The container seal may be, for example, a cork or a screw cap. Attaching the container adapter adjacent to the container seal may enable the container seal of the container to be opened while preserving the fluid in the container by prevent air from an ambient environment surrounding the container from interacting with the fluid in the container during and/or after opening of the container seal.

In one or more embodiments of the invention, a system may include the container adapter and a container seal remover. The container seal remover may be a physical device used to open a seal of a container while the container adapter is attached to the container. The container seal remover may cooperate with the container adapter to preserver the fluid in the container during and/or after removal of the container seal.

In one or more embodiments of the invention, the container seal remover may reversibly attach to the container adapter. While attached to the container adapter, a sealed compartment may be formed. A seal remover of the container seal remover may be disposed in the sealed compartment. The seal remover may remove a seal of the container through the container adapter while the sealed compartment is formed.

In one or more embodiments of the invention, the container seal remover may include an atmospheric regulator that regulates the atmosphere of the chamber while the seal of the container is removed by the seal remover. The atmospheric regulator may regulate the atmosphere within the chamber by purging the chamber with an inert gas such as, for example, argon or nitrogen, replicating the gas naturally in a wine at the time of bottling including inert gas combined with sulfur dioxide $SO_2$, and/or by removing gasses by generating a vacuum/reduce pressure in a chamber of the container adapter.

In one or more embodiments of the invention, a system includes a container adapter and a dispensing device. The dispensing device may include an extraction element that cooperates with the container adapter to enable liquid to be removed from a container while preventing ambient gasses or other undesirable elements from interacting with the liquid in the container.

In one or more embodiments of the invention, a system includes a container adapter, a dispensing device, and an appliance/manual dispenser. The appliance or manual dispenser may be used in conjunction with the adapter and dispensing device to enable liquid to be removed from a container while preventing ambient gasses or other undesirable elements from interacting with the liquid in the container.

In one or more embodiments of the invention, a system includes a container including an alternative container seal, a dispensing device, and an appliance/manual dispenser. The alternative container seal may be a resealable interface. The appliance or manual dispenser may be used in conjunction with the alternative container seal and dispensing device to enable liquid to be removed from a container while preventing ambient gasses or other undesirable elements from interacting with the liquid in the container.

In one or more embodiments of the invention, a method of preserving a fluid may include attaching a container adapter to a container. A container seal remover may be attached to the container adapter to form a sealed chamber. A seal remover of the container seal remover may remove the seal of the container through a resealable interface of the container adapter. After removing the container seal, the resealable interface of the container adapter may be resealed. After resealing the resealable interface, the container seal remover may be detached from the container.

In one or more embodiments of the invention, the container adapter and/or dispensing device may be attached to another device such as, for example, an appliance, i.e., an automatic fluid dispenser, or a manual dispenser, i.e., a handheld device for dispensing fluids.

In one or more embodiments of the invention, the manual dispenser is a manually actuated attachment that may be reversibly attached to the container adapter and/or dispensing device. The manual dispenser may enable fluid to be dispensed from a container on which the container adapter is attached when the manual dispenser is manually actuated by a user.

In one or more embodiments of the invention, the appliance is an appliance adapted to receive containers having container adapters attached. The appliance may include a dispensing device that cooperates with the container adapter to extract fluid from the container. The appliance may assist in preserving the fluid disposed within the container during and/or after dispensing a portion of the fluid. The appliance may assist in preserving the fluid by regulating an atmosphere within/near the container and/or a temperature of the fluid within the container.

In one or more embodiments of the invention, the appliance includes an extraction element that reversibly unseals an interface of the container adapter without damaging the interface. For example, the extraction element may be a needle having a tip adapted to penetrate the interface without coring or otherwise removing portions of the interface, e.g., without damaging a resealable interface.

FIG. 1A shows a container adapter (100) disposed on a container (105) in accordance with one or more embodiments of the invention. The container adapter may be a physical device. The container adapter (100) may be used to dispense a portion of a fluid disposed in the container (105) while preserving the remaining portion of the fluid in the container (105) during/after dispensing the fluid.

In one or more embodiments of the invention, the container (105) may be a bottle. The bottle may include a liquid. The liquid may be wine. The bottle may include other liquids without departing from the invention. The bottle may include a seal (not shown). The seal may be, for example, a cork or a screw top. The seal may be other types of seals without departing from the invention.

In one or more embodiments of the invention, the container adapter (100) may be adapted to operate across a broad range of temperatures, e.g., 0°-120° Fahrenheit. For example, the materials of which the container adapter (100) are made may be selected for their ability to function across the broad range of temperatures and the structure may include multiple temperature compliant interfaces that enable the container adapter (100) to expand and/or contract without damaging its structure in a manner that would lead to a mechanical failure of the container adapter (100). By doing so, the container adapter (100) may be chilled, or otherwise have its temperature modified, prior to and/or while being disposed on a container. For example, if the container (105) includes a liquid that is best served in a chilled state, a user of the container adapter (100) may chill the container adapter (100) prior to installing it. Similarly, once installed, the container adapter (100) along with or separate from the container (105) may be chilled or heated while still providing its functionality. Still further, in one or more embodiments of the invention, the container (105) and container adapter (100) may be placed in an appliance that both chills a fluid included in the container (105) and dispenses the fluid.

Figure 1B:
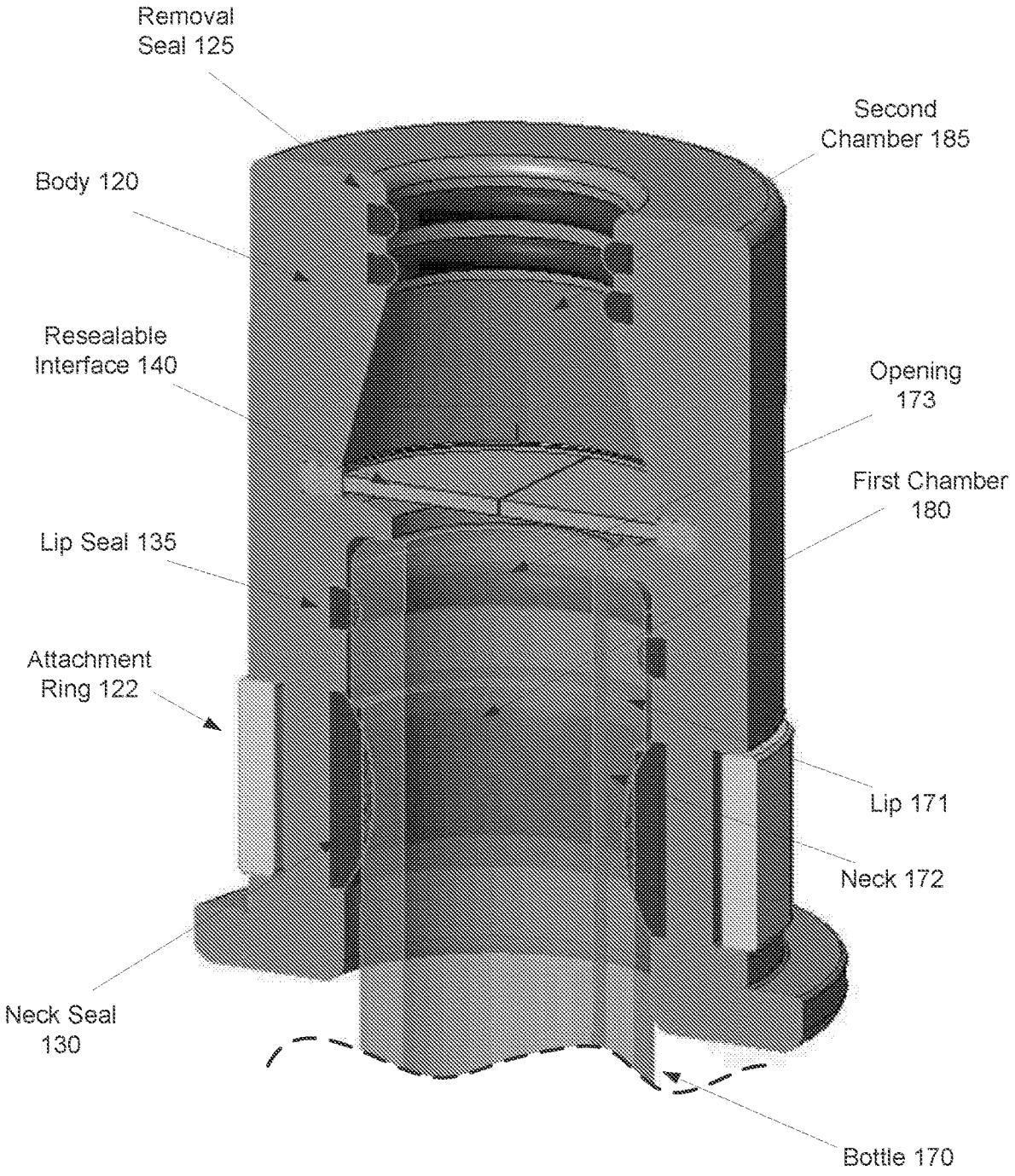
FIG. 1B shows a diagram of a container adapter and a container in accordance with one or more embodiments of the invention disposed on a container with a portion of the container adapter and the container removed.
Figure 1C:
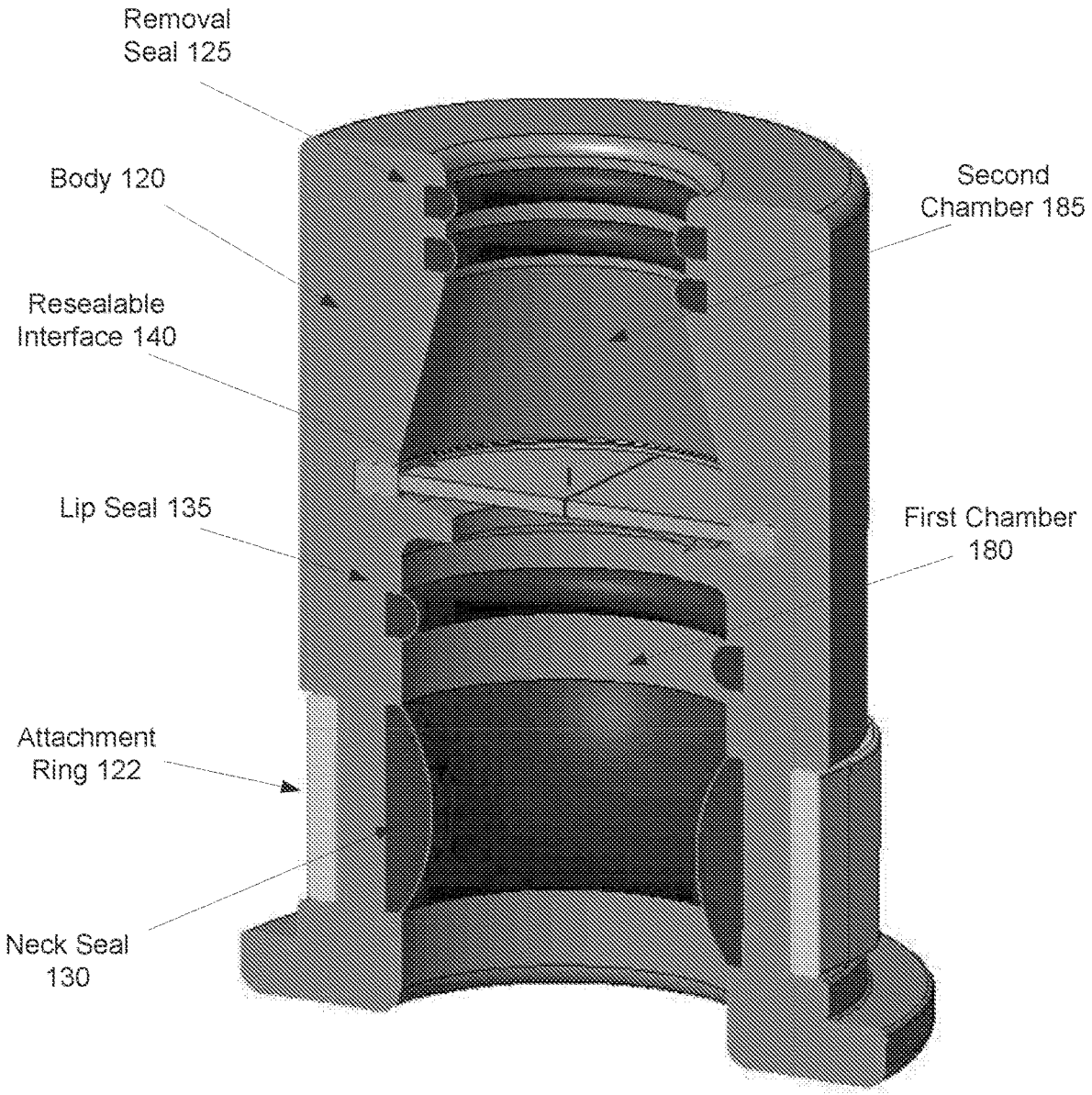
FIG. 1C shows a diagram of a container adapter in accordance with one or more embodiments of the invention with a portion of the container adapter removed.
Figure 1D:
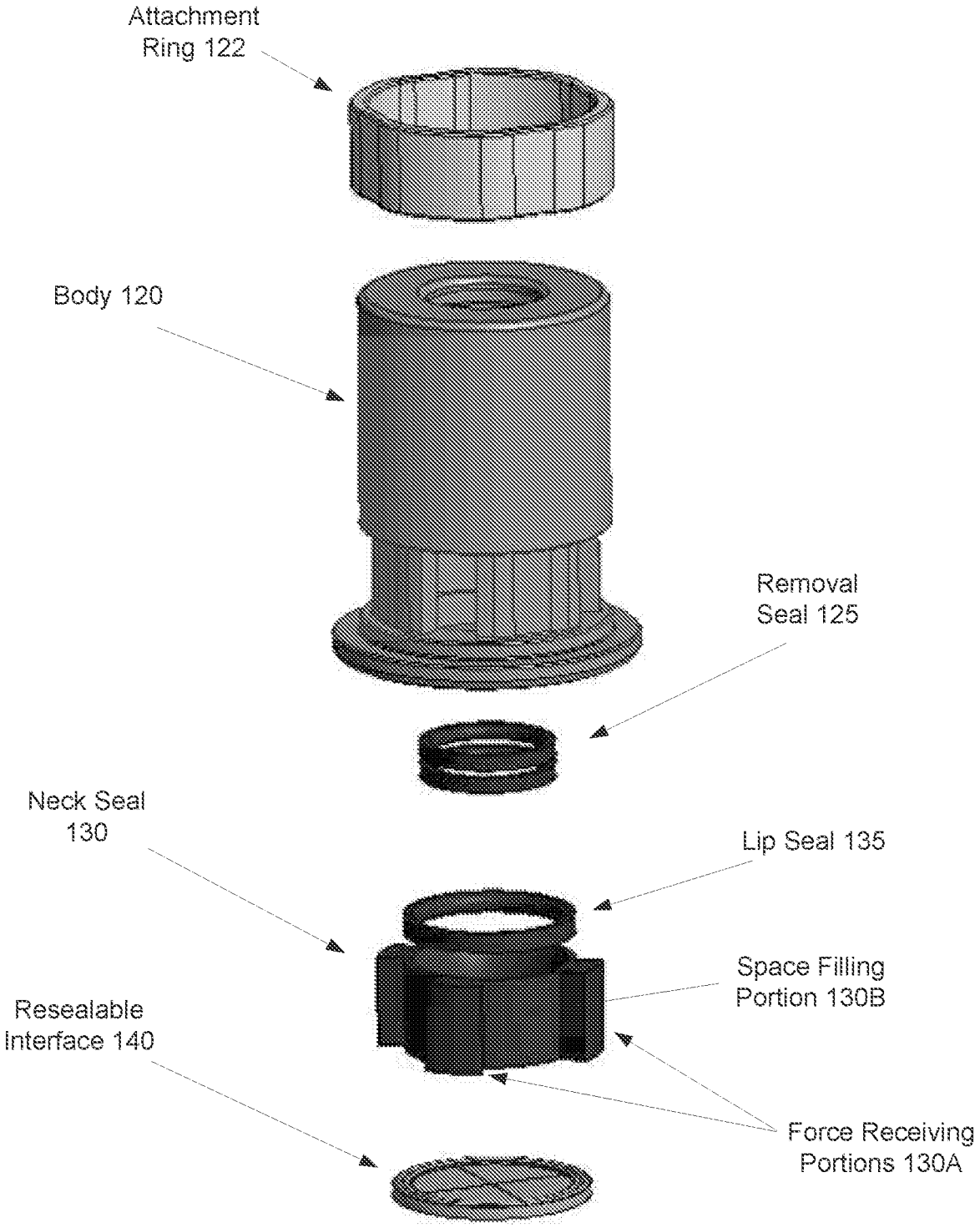
FIG. 1D shows an exploded diagram of a container adapter in accordance with one or more embodiments of the invention.

To further clarify the container adapter (100), FIGS. 1B-1D show different views of the container adapter (100). FIG. 1B shows a partial diagram of the container adapter (100) of FIG. 1A attached to a bottle (170). In FIG. 1B, a portion of the diagram shown in FIG. 1A has been removed to illustrate internal components of the container adapter (100). FIG. 1C shows a partial diagram of the container adapter of FIG. 1B separately from the bottle (170) of FIG. 1B. In FIG. 1C, a portion of the diagram shown in FIG. 1A has been removed to illustrate internal components of the container adapter (100). FIG. 1D shows an exploded diagram of the container adapter (100) of FIG. 1A. Similar components of the container adapter (100) are similarly numbered in FIGS. 1A-1D.

Returning to FIG. 1B, the container adapter (100) may include a body (120), an attachment ring (122), a neck seal (130), a lip seal (135), and a resealable interface (140). Each component of the container adapter (100) is discussed below.

The body (120) may be a structural component of the container adapter (100). The body (120) may be formed from plastic. The plastic may be polystyrene, polyethylene, (pc) polycarbonate; (abs) Acrylonitrile butadiene styrene; nylon; polypropylene; polystyrene; or polyethylene.

The body (120) may be formed of metal. The metal may be aluminum, zinc, or stainless steel. In one or more embodiments of the invention, the metal body (120) is coated to impart corrosion resistant. In one or more embodiments of the invention, the metal body (120) is coated with a decorative metal such as, for example, copper, nickel, chromium, or tin. The decorative metal may be other types of metals without departing from the invention. In such a scenario, the body (120) may comprise an inner core of a first metal or plastic and an outer layer of decorative metal that either (i) entirely or (ii) partially encapsulates the inner core.

The body (120) may include a first chamber (180) and a second chamber (185). The first chamber (180) may be separated from the second chamber (185) by the resealable interface (140).

The first chamber (180) may be adapted to attach to a portion of a container. The container may be a bottle (170). In FIG. 1B, the first chamber (180) is illustrated in a condition where a portion of a bottle has been disposed in the first chamber (180). The portion of the bottle (170) may be a neck and lip of the bottle (170). While illustrated as attaching to the neck and lip of the bottle (170), the first chamber (180) may be adapted to attach to a container in different manners without departing from the invention. For example, the first chamber may seal to a top of the lip rather than an exterior of the lip (171) as illustrated in FIG. 1B. In such a scenario, the first chamber (180) may include an annular sealing surface (not shown) proximate to the resealable interface (140) for generating a top lip seal (not shown) rather than the lip seal (130) as illustrated in FIG. 1B.

The first chamber (180) may be adapted to attach to a portion of a container by having a shape that is complimentary to a shape of the portion of the bottle (170) to which the first chamber (180) is adapted to attach. In one or more embodiments of the invention, the shape of the first chamber (180) may be cylindrical and the cylindrical shape may have a diameter that is slightly larger than a diameter of the lip of the bottle (170). As used herein, slightly larger means 20% or less larger than the diameter of the lip of the bottle. For example, for a bottle having a lip with a diameter of 10 mm, the diameter of the cylindrical shape of the first chamber (180) may be between 10 mm and 12 mm.

As used herein, the lip (171) of the bottle (170) refers to the tubular portion of the bottle, adjacent to the cork (160), that has a diameter larger than the neck (172) of the bottle. The neck (172) of the bottle may be the portion of the bottle (170), adjacent to the lip (171) of the bottle (170), that has a diameter smaller than the neck of the bottle (170).

The first chamber (180) may include sealing surfaces that form seals between the first chamber (180) and a container when a portion of the container is disposed with the first chamber (180). The sealing surface may be formed from rubber, Polytetrafluoroethylene (Teflon®), Polydimethylsiloxane, silicone, urethane, nitrile rubber, and/or fluorocarbon rubber. The sealing surface may be formed from other materials without departing from the invention.

In one or more embodiments of the invention, the sealing surfaces may be ring gaskets disposed in portions of the body (120). The portions of the body (120) may be circular recesses. The seals formed between the sealing surfaces and the body may prevent or reduce the flow of air between an ambient environment and the first chamber (180) and/or second chamber (185).

In one or more embodiments of the invention, the first chamber (180) includes a neck seal (130) and/or a lip seal (135). The neck seal (130) and the lip seal (135) may create two distinct seals between the body (120) and the container when the container is disposed in the first chamber (180). The aforementioned seals, when formed, may prevent and/or reduce airflow between an ambient environment and the portion of the first chamber (180) adjacent to the container seal of the container. For example, in FIG. 1B, the portion of the first chamber may be the area between the resealable interface (140) and the opening (173) of the bottle (170).

The first seal may be between the body (120) and a first portion of the container and the second seal may be between the body (120) and a second portion of the container. The first portion of the container may be a neck (172) of a bottle (170) and the second portion of the container may be a lip (171) of the bottle (170).

The neck seal (130) may be disposed adjacent to the lip seal (135) in the body (120) and enables a portion of the container including the lip (171) to be moved into the first chamber (180). The neck seal (130) may be a ring gasket that has an annular thickness larger than an annular thickness of the lip seal (135).

The lip seal (135) may be disposed between the neck seal (130) and the resealable interface (140). The lip seal (135) may be a ring gasket that has an annular thickness smaller than an annular thickness of the neck seal (130).

The second chamber (185) may be adapted to enable a container seal to be removed through the container adapter while the container adapter is attached to the container. The second chamber (185) may be adapted to enable the container seal to be removed by having a shape that enables the container seal to be moved to the second chamber (185), from the first chamber (180), through the resealable interface (140). The container seal may then be removed from the second chamber (185) once it is located in the second chamber.

The second chamber (185) may have a shape that is complimentary to a shape of the container seal of the container. For example, the container seal may be a cork (160) having a cylindrical shape and the second chamber (185) may have a cylindrical shape. The cylindrical shape of the second chamber (185) may have a diameter that is larger than a diameter of the cork.

The second chamber (185) may include sealing surfaces that form seals between the second chamber (185) and a container seal during a portion of the process of removing the container seal through the second chamber (185). The sealing surface may be formed from rubber, Polytetrafluoroethylene (Teflon®), Polydimethylsiloxane, silicone, urethane, nitrile rubber, or fluorocarbon rubber. The sealing surface may be formed from other materials without departing from the invention.

In one or more embodiments of the invention, the sealing surfaces are ring gaskets placed in recesses in plastic. In one or more embodiments of the invention, the sealing surfaces are "overmolded" into the recess in the plastic. In other words, the sealing surface may be an additional layer disposed on a plastic body.

In a scenario in which ring gaskets are utilized, the ring gaskets may be disposed in portions of the body (120). The portions of the body (120) may be circular recesses. The seals formed between the sealing surfaces and the body (102) may prevent or reduce the flow of air between an ambient environment and the first chamber (180) and/or second chamber (185).

In one or more embodiments of the invention, the second chamber (185) may include a removal seal (125). The removal seal (125) may create a seal between the body (120) and the container seal during a portion of the container seal removal process. The aforementioned seals, when formed, may prevent and/or reduce airflow between an ambient environment and the portion of the second chamber (185) adjacent to the container. For additional details regarding the second chamber (185) and removal seal (125) during the process of removing the container seal, See FIGS. 3A-4D.

As discussed above, the resealable interface (140) may be disposed between the first chamber (180) and the second chamber (185). The resealable interface (140) may be a surface that may be opened and resealed. When the resealable interface is in an open state, the first chamber (180) and the second chamber (185) may be hydraulically linked, i.e., materials such as fluids or gasses may flow between the chambers. When the resealable interface is in a closed state, the first chamber (180) and the second chamber (185) may be hydraulically isolated, i.e., materials such as fluids or gasses may be prevented flowing between the chambers or the flow between the chambers may be reduced when compared to the amount of material that flows between the chambers while the resealable interface (140) is in an open state.

In one or more embodiments of the invention, the resealable interface (140) may be a physical device that may be actuated to change its state between open and closed. The physical device may be, for example, a valve. The valve may be, for example, a one-way valve, a duckbill valve, or an iris valve. The physical device may by other fluid flow control devices without departing from the invention.

In one or more embodiments of the invention, the resealable interface (140) may be actuated by the application of force. The force may be, for example, compressive force. The compressive force may be applied by, for example, the fingers of a user pinching a portion of the container adapter. The compressive force may be applied by, for example, the fingers of a user pressing on a portion of the container adapter.

In one or more embodiments of the invention, the resealable interface (140) may be actuated by the application of force by gravity. The force may be, for example, bending force caused by fluid pressing against the resealable interface (140). The bending force may be applied by, for example, a user turning the container, with the container adapter attached, upside down and thereby causing the fluid in the container to be pressed against the resealable interface (140). The bending force may cause portions of the resealable interface to deform and thereby change the state of the resealable interface (140) to an open state.

In one or more embodiments of the invention, the resealable interface (140) may be actuated by the application of force by a fluid extraction device. The fluid extraction device may press against the resealable interface (140) through the second chamber (185). The fluid extraction device may be, for example, a dispensing device. For additional details regarding actuation of the resealable interface (140) by a fluid extraction device, See FIGS. 6A-7E.

In one or more embodiments of the invention, the resealable interface (140) may be implemented with a resting position that causes the resealable interface (140) to be in a closed state. For example, the resealable interface (140) may be implemented using an elastic material that has internal stress that causes the resealable interface (140) to return to a shape that closes the resealable interface (140).

For additional details regarding the resealable interface (140), See FIGS. 1C-1D.

The first chamber (180) and the second chamber (180) may both be open to an ambient environment when the container adapter (100, FIG. 1A) is not disposed on a bottle (170), e.g., both chambers may be cylindrical volumes with at least one open end and separated by a resealable interface (140) on respective other ends of the chambers. The surfaces facing an inside of the cylindrical volumes may be referred to as interior surfaces and the surfaces facing an outside of the cylindrical volumes may be referred to as exterior surfaces.

As discussed above, the container adapter may be attached to the container. The container adapter may include an attachment ring (122). The attachment ring (122) may be a physical device used to facilitate attachment of the container adapter to the container. The attachment ring (122) may be ring shaped and may be disposed in a recess on the body (120).

In one or more embodiments of the invention, the attachment ring (122) may actuate the neck seal (130) to attach the container adapter to a container. For example, the shape of the attachment ring (122) may compress a portion of the neck seal (130) when rotated and thereby form a seal between the body (120) and a neck (172), or other portion, of a container. For additional details regarding the interaction of the attachment ring (122) and the neck seal (130), See FIGS. 1D and 3A-3D.

To further clarify the structure of the container adapter illustrated in FIG. 1B, FIG. 1C shows a similar diagram without a container. As seen from FIG. 1C, the first chamber (180) is separated from the second chamber (185) by the resealable interface (140).

To further clarify various components of the container adapter illustrated in FIG. 1B, FIG. 1C shows an exploded diagram of the container adapter. As seen from FIG. 1D, the container adapter includes a body (120).

In one or more embodiments of the invention, the body (120) is a physical component. The body (120) may be formed from plastic injection molded plastic, or other materials. The body include openings by which other components may be inserted into the first chamber (180, FIG. 1B) or the second chamber (185, FIG. 1B). The body (120) may also include attachment points/structures for other components of the container adapter. For example, the body (120) may include recesses for the attachment of sealing elements such as, for example, the removal seal (125), lip seal (135), neck seal (130), and/or resealable interface (140). The body (120) may include recesses for the attachment of the attachment ring (122).

While the body (120) is illustrated as including a limited number of attachment point/structures for the attachment or interaction of other components, the body (120) may include fewer, additional, or different attachment points/structures without departing from the invention.

In one or more embodiments of the invention, the removal seal (125) is a physical component. The removal seal (125) may be formed from a pliable material such as rubber. The removal seal (125) may include multiple, separate physical components such as, for example, two gaskets. The removal seal (125) may facilitate the generation of seals between the body (120) and a container seal of a container while the container seal is being removed from the container through a portion of the body (120).

While the removal seal (125) is illustrated as two gaskets, the removal seal (125) may be of a different shape, include fewer or additional components, and/or be formed of a material other than rubber without departing from the invention.

In one or more embodiments of the invention, the lip seal (135) is a physical component. The lip seal (135) may be formed from a pliable material such as rubber. The lip seal (135) may include multiple, separate physical components such as, for example, two gaskets. The lip seal (135) may facilitate the generation of seals between the body (120) and a lip of a container while the container adapter is attached to the container.

While the seal lip seal (135) is illustrated as a gasket, the lip seal (135) may be of a different shape, include fewer or additional components, and/or be formed of a material other than rubber without departing from the invention.

In one or more embodiments of the invention, the neck seal (130) is a physical component. The neck seal (130) may be formed from a pliable material such as rubber. The neck seal (130) may include multiple, separate physical components such as, for example, multiple gaskets or may be a single physical component. The neck seal (130) may facilitate the generation of seals between the body (120) and a neck of a container while the container adapter is attached to the container.

In one or more embodiments of the invention, the neck seal (130) is adapted to change shape when force is applied to the neck seal (130) by the attachment ring (122). Specifically, the neck seal (130) may be adapted to fill a gap between the body (120) and a container while the container adapter is attached to the container.

In one or more embodiments of the invention, the neck seal (130) includes force receiving portions (130A) that extend from a space filling portion (130B). The force receiving portions (130A) may receive force applied by the attachment ring (122) and transmit the received force to the space filling portion (130B). In response to receiving the transmitted force, the space filling portion (130B) may change shape to fill space, or a portion thereof, between the body (120) and a portion of a container disposed within the body (120). The space filling portion (130B) may be elastic and, in response to the cessation of force transmission by the force receiving portions (130A), empty the space, or the portion thereof, between the body (120) and the portion of the container within the body (120).

The neck seal (130) may be of a different shape than as illustrated in FIG. 1D, include fewer or additional components, and/or be formed of a material other than rubber without departing from the invention.

In one or more embodiments of the invention, the resealable interface (140) is a physical component. The resealable interface (140) may be formed from a pliable material such as rubber. The resealable interface (140) may include multiple, separate physical components or may be a single physical component. The resealable interface (140) may facilitate the generation of a seal between two chambers within the body (120) that may be reversibly unsealed.

The resealable interface (140) may be of a different shape than as illustrated in FIG. 1D, include fewer or additional components, and/or be formed of a material other than rubber without departing from the invention.

In one or more embodiments of the invention, the attachment ring (122) is a physical component. The attachment ring (122) may be formed from a structural material such as a metal or metal coated plastic. The attachment ring (122) may include multiple, separate physical components or may be a single physical component. The attachment ring (122) may reversibly apply force to the force receiving portions (130A) of the neck seal (130). The force may be reversibly applied by, for example, rotating the attachment ring (122) about the body (120).

In one or more embodiments of the invention, the attachment ring (122) may have a circular shape with a diameter that varies about the circular shape. For example, the attachment ring (122) may a diameter that is smaller along two Cartesian axes, e.g., 0°, 90°, 180°, and 270°, than a diameter off the two Cartesian axes, e.g., 45°, 135°, 225°, and 315°. By having diameters with different sizes, rotating the attachment ring (122) with respect to the neck seal (130) may reversibly apply force to the force receiving portions (130A). The attachment ring (122) may have a diameter that varies about its shape with any degree of frequency without departing from the invention. Additionally, the variation of the diameter may not be periodic without departing from the invention.

The attachment ring (122) may be of a different shape than as illustrated in FIG. 1D, include fewer or additional components, and/or be formed of a material other than metal or metal coated plastic without departing from the invention.

In one or more embodiments of the invention, the container adapter illustrated in FIGS. 1A-1D is used in conjunction with a container seal remover. For example, after the container adapter is attached to a container, the container seal remover may remove a container seal through the container adapter. Doing so may reduce/prevent the introduction of atmospheric gasses or other materials into the container that may degrade a liquid in the container.

Figure 2A:
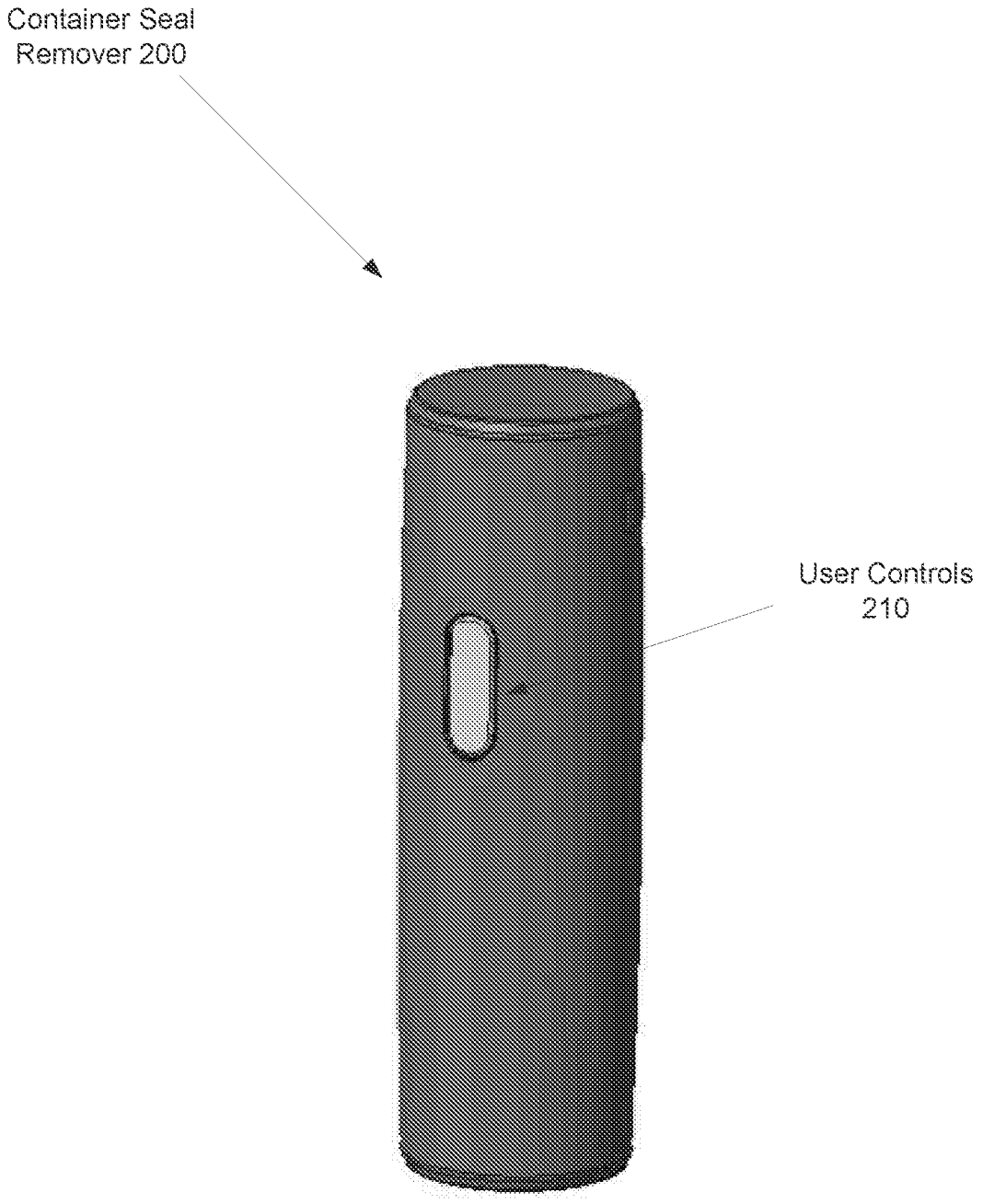
FIG. 2A shows a diagram of a container seal remover in accordance with one or more embodiments of the invention.

FIG. 2A shows a diagram of a container seal remover (200) in accordance with one or more embodiments of the invention. The container seal remover (200) may be a physical device. The container seal remover (200) may user controls (210) such as, for example, buttons or other physical components, that control the operation of the container seal remover (200).

Figure 2B:
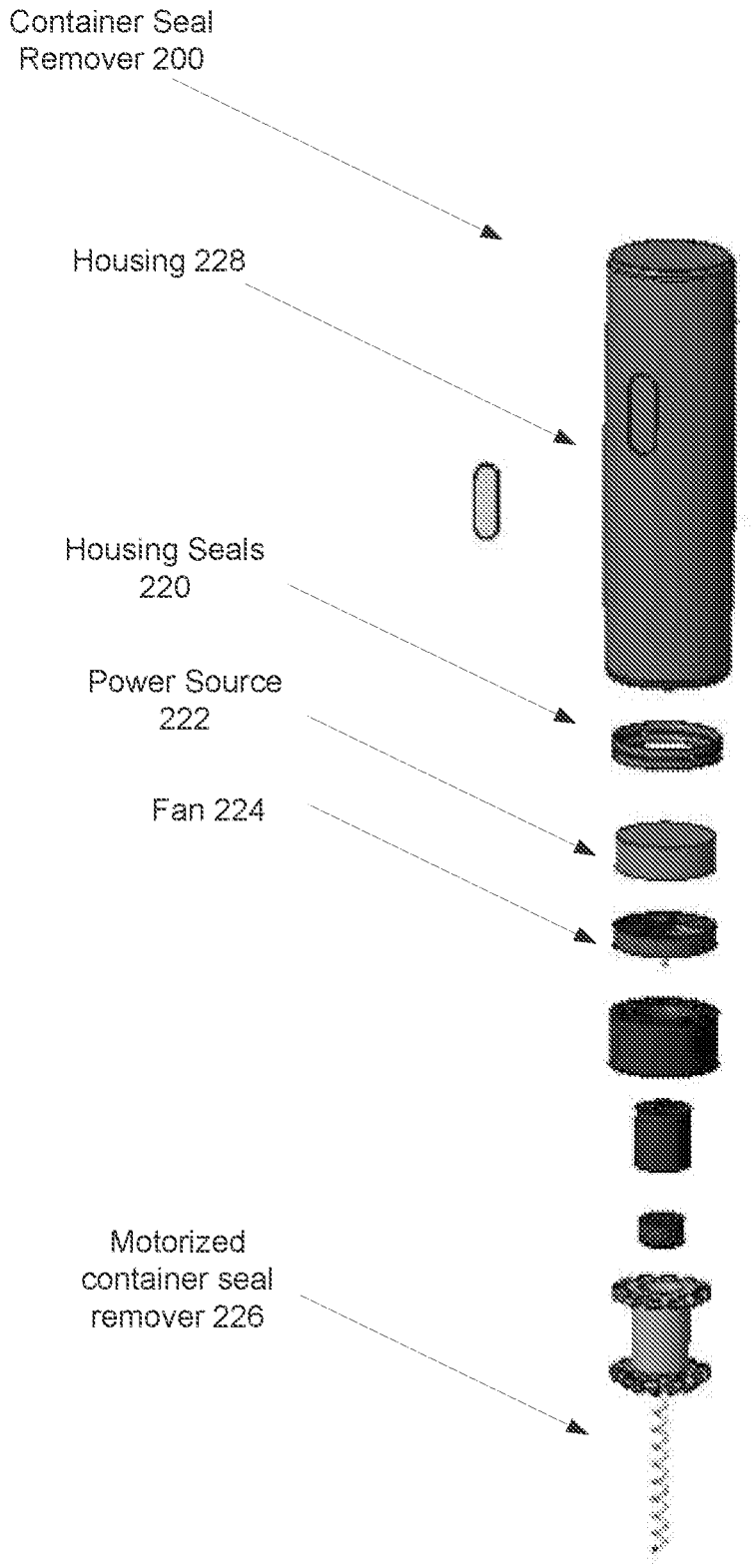
FIG. 2B shows an exploded diagram of a container seal remover in accordance with one or more embodiments of the invention.

FIG. 2B shows an exploded diagram of the container seal remover (200) of FIG. 2A in accordance with one or more embodiments of the invention. The container seal remover (200) includes housing seals (220), a power source (222), a fan (224), a motorized container seal remover (226), and a housing (228). The container seal remover (200) may include additional, different, or fewer components without departing from the invention. Each component of the container seal remover (200) is discussed below.

In one or more embodiments of the invention, the housing (228) is a physical structure. The housing (228) may be formed of, for example, plastic, metal coated plastic, or another structural material without departing from the invention. The housing (228) may be in the shape of a shell that includes an opening to receive a container adapter. The opening to receive the container adapter may have a shape that is complimentary to a shape of the container adapter. For example, the opening may have a circular cross section to complement a circular cross section of the container adapter. The shell may be tubular shaped with an opening on one end of the tubular shape. The shell may include additional openings without departing from the invention.

While the housing (228) is illustrated as having a tubular shape, the housing (228) may be of a different shape, include fewer or additional components, and/or be formed of a material other than plastic or metal coated plastic without departing from the invention.

In one or more embodiments of the invention, the housing seals (220) are physical structures. The housing seals (220) may facilitate the formation of a sealed compartment within the housing (228) while the container seal remover (200) is attached to a container adapter. The housing seals (220) may be formed from a pliable material such as rubber. The housing seals (220) may be one or more gaskets.

While the housing seals (220) are illustrated as ring gaskets, the housing seals (220) may be of different shapes, include fewer or additional components, and/or be formed of a material other than rubber without departing from the invention.

In one or more embodiments of the invention, the power source (222) is a physical structure. The power source (222) may be, for example, a battery, super capacitor, or wireless power supply module. The power source (222) may be other types of components that supply power without departing from the invention. The power source (222) may provide power to the motorized container seal remover (226).

While the power source (222) is illustrated as a single battery, the power source (222) may be formed from multiple components without departing from the invention.

In one or more embodiments of the invention, the motorized container seal remover (226) is a physical structure. The motorized container seal remover (226) may be, for example, a corkscrew attached to the drive of a motor or a cork puller. The motorized container seal remover (226) may be other types of structures for removing seals of containers without departing from the invention. For example, the motorized container seal remover (226) may be a needle adapted to penetrate a container and inject a gas into the container until a seal of the container is removed via pressure caused by injection of the gas. The motorized container seal remover (226) may be implemented using other types of components without departing from the invention. For example, the motorized seal remover may be complimentary to a type of seal on a container and adapted to remove the seal on the container. The motorized container seal remover (226) may remove a container seal of a container.

Figure 2C:
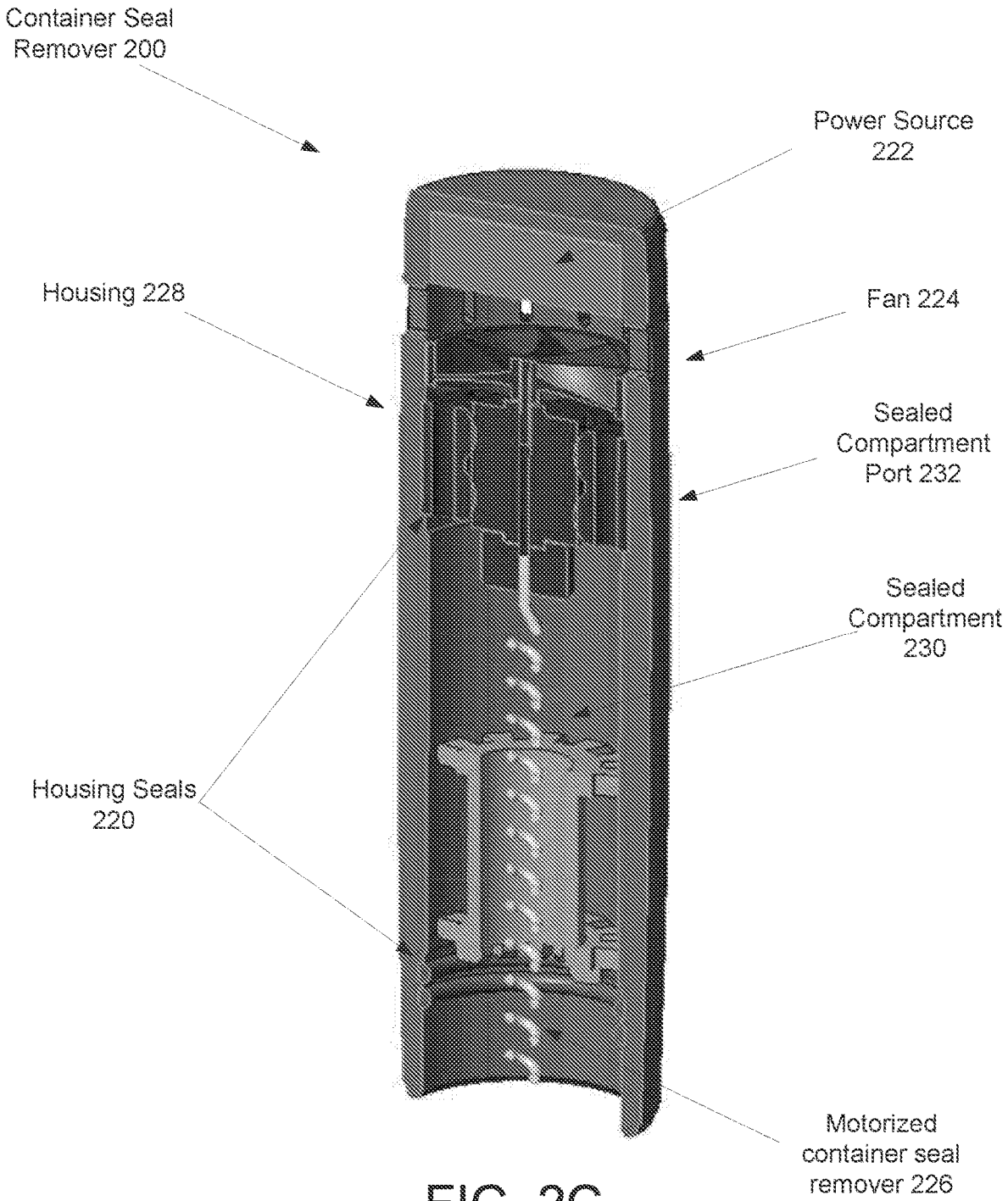
FIG. 2C shows an exploded diagram of a container seal remover in accordance with one or more embodiments of the invention with a portion of the container seal remover removed.

To further clarify the structure of the container seal remover (200) illustrated in FIG. 2A, FIG. 2C shows a diagram of the container seal remover (200) with a portion removed to reveal an internal arrangement of the component of the container seal remover (200).

As seen in FIG. 2C, the housing (228) may include a sealed compartment (230) that is reversibly sealed when a portion of a container adapter is inserted into the lower portion of the housing (228). Specifically, the housing seals (220) adjacent to the opening create a seal between the housing (228) and the container adapter when inserted into the housing (228). Additionally, the housing seals (220) create a seal between components of the motorized container seal, e.g., motor at the top of the corkscrew, that seals the sealed compartment (230) from the ambient atmosphere.

In one or more embodiments of the invention, the housing (228) includes a sealed compartment port (232) that enables gasses or liquids to be inserted into or removed from the sealed compartment. For example, a vacuum may be attached to the sealed compartment port (232) and thereby remove gasses within the sealed compartment. In another example, a gas source may be attached to the sealed compartment port (232) and thereby inject predetermined gasses that displace atmospheric gasses within the sealed compartment (230). The sealed compartment port (232) may be a threaded, press seal, or any other type of gas/liquid connection between the sealed compartment (230) and the exterior of the housing (228).

As discussed above, the container adapter and the container seal remover may be used in conjunction with each other to facilitate the removal of a container seal while preserving the contents of the container. FIGS. 3A-3D illustrate an example interaction between a container adapter and a container seal remover over time.

The container adapter (300) and container seal remover (320) illustrated in FIGS. 3A-3D are similar to the container adapter and seal remover illustrated in FIGS. 1B-2C and, consequently, include similar components. For brevity and clarity, only a limited number of reference numerals are included in each of FIGS. 3A-3D.

Figures 3A, 3B, 3C, 3D:
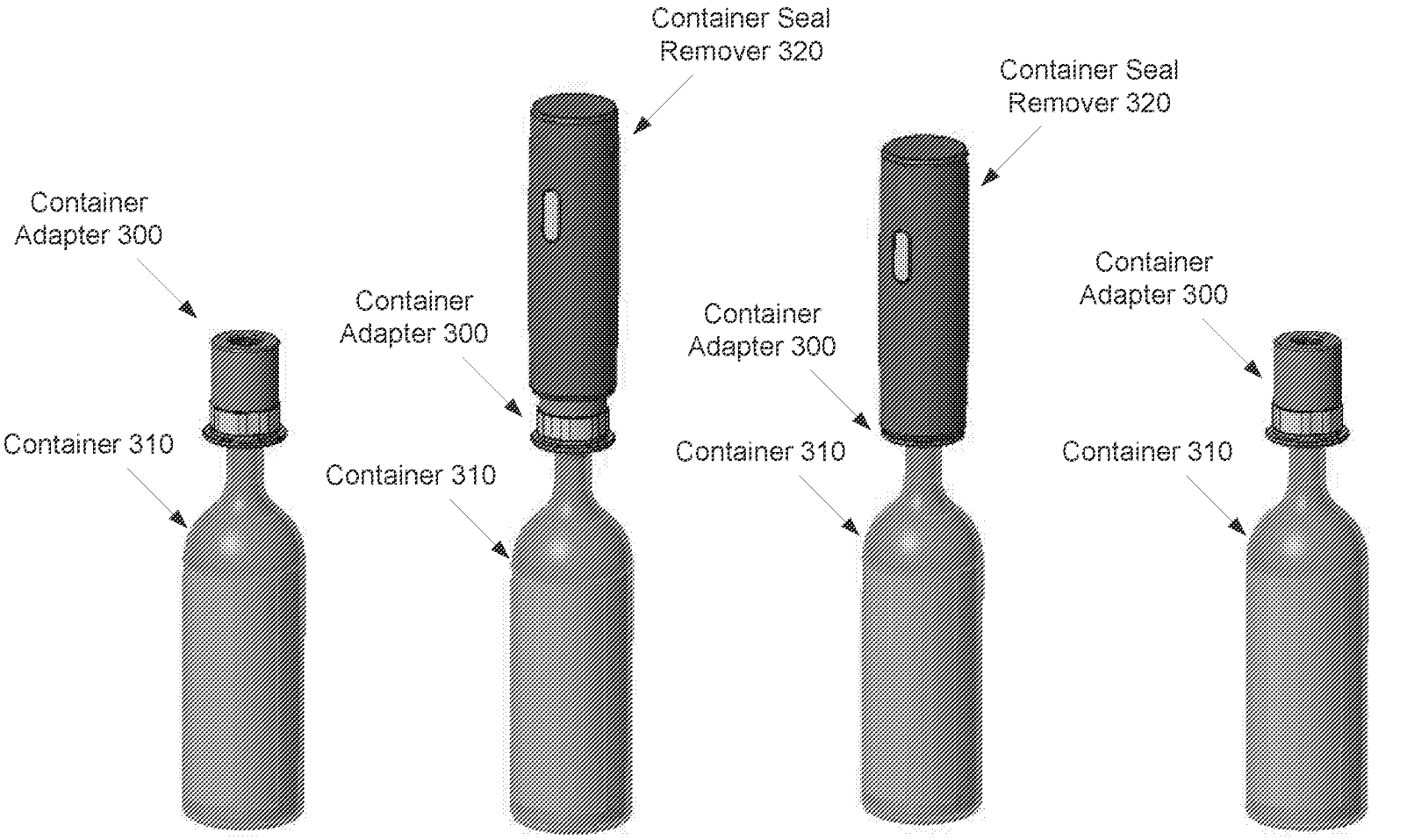
FIG. 3A shows a diagram of a container, a container adapter, and a container seal remover in accordance with one or more embodiments of the invention at a first point in time.
FIG. 3B shows a diagram of a container, a container adapter, and a container seal remover in accordance with one or more embodiments of the invention at a second point in time.
FIG. 3C shows a diagram of a container, a container adapter, and a container seal remover in accordance with one or more embodiments of the invention at a third point in time.
FIG. 3D shows a diagram of a container and a container adapter in accordance with one or more embodiments of the invention at a fourth point in time.

FIG. 3A shows a diagram of a container adapter (300) attached to a container (310). The container adapter (300) was attached to the container (310) may placing the container adapter (300) onto the container. Once placed on the container adapter (300), the attachment ring of the container adapter (300) was rotated and thereby formed a seal between the container adapter (300) and the container (310).

For example, in FIG. 3A the container adapter (300) may be slightly above its ideal attachment point with the container (310) by virtue of friction with the container. In other words, in FIG. 3A, the container adapter (300) may be sitting on top of the container (310) in a state where it needs to traverse downward with respect to its orientation in FIG. 3A while the container (310) stays in a static position to place the container adapter (300) in an ideal attachment point with respect to the container (310).

FIG. 3B shows a diagram of a container adapter (300) attached to a container (310) while a container seal remover (320) is being attached to the container adapter (300). By placing the container seal remover (320) on the container adapter (300), a seal between the container adapter (300) and the container seal remover (320) is formed.

FIG. 3C shows a diagram of a container adapter (300) attached to a container (310) and a container seal remover (320) attached to the container adapter (300). In this configuration, the container adapter (300) is sealed to the container (310) and the container seal remover (320) is sealed to the container adapter (300). Thus, in this configuration, a seal of the container (310) is isolated from the ambient environment and a compartment of the container seal remover (320) is isolated from the ambient environment. The container of the container seal remover (320) and the seal of the container (310) are separated from the resealable interface of the container (310). In this configuration, a user may apply a vacuum or inject a gas into the isolated chamber of the container seal remover (320) to remove/reduce the quantity of atmospheric gasses in the isolated chamber of the container seal remover (320). After removing/reducing the quantity of atmospheric gasses in the isolated chamber of the container seal remover (320), a user may active a motorized seal remover of the container seal remover (320) and thereby cause a seal of the container (310) to be removed. Once the container seal is removed, the resealable interface may reseal and thereby isolate the interior of the container and the contents therein, from the isolated chamber of the container seal remover (320). For additional details regarding removal of the container seal, See FIGS. 4A-4D.

Attaching the container seal remover (320) may change the position of the container adapter (300) with respect to the container (310). For example, pushing the container seal remover (320) down towards the container (310) may apply force to the container adapter (300) that positions the container adapter (300) in the ideal attachment location with respect to the container (310). By doing so, the container adapter (300) may be put in an ideal location for forming seals between itself and the container (310). For example, the container adapter (300) may be pressed tightly against the lip of the container (310).

FIG. 3D shows a diagram of a container adapter (300) attached to a container (310) after the container seal has been removed and after the container seal remover has been removed. In this configuration, the interior of the container (310) is separated from the ambient environment by the resealable interface of the container adapter (300). The container seal is no longer present. As noted above, seals between the container adapter (300) and the container (310) are easily maintained in the topology of FIG. 3D because the container adapter (300) was pressed into an ideal location with respect to the container (310) by the container seal remover (320).

To further clarify the process of removing the container seal as discussed in FIG. 3C, FIGS. 4A-4D show diagrams illustrating portions of the processes of removing the container seal through a container adapter. In FIGS. 4A-4D, the container adapter (400) and container seal remover are similar to the container adapter and seal remover illustrated in FIGS. 1B-2C and, consequently, include similar components. For brevity and clarity, only a limited number of reference numerals are included in each of FIGS. 4A-4D. In each of FIGS. 4A-4D, a portion of the container seal remover (420), container adapter (400), and container (410) have been removed to illustrate the arrangement of internal components throughout the process of removing the container seal. Each of FIGS. 4A-4D represent portions of the process of removing the container seal.

Figure 4A:
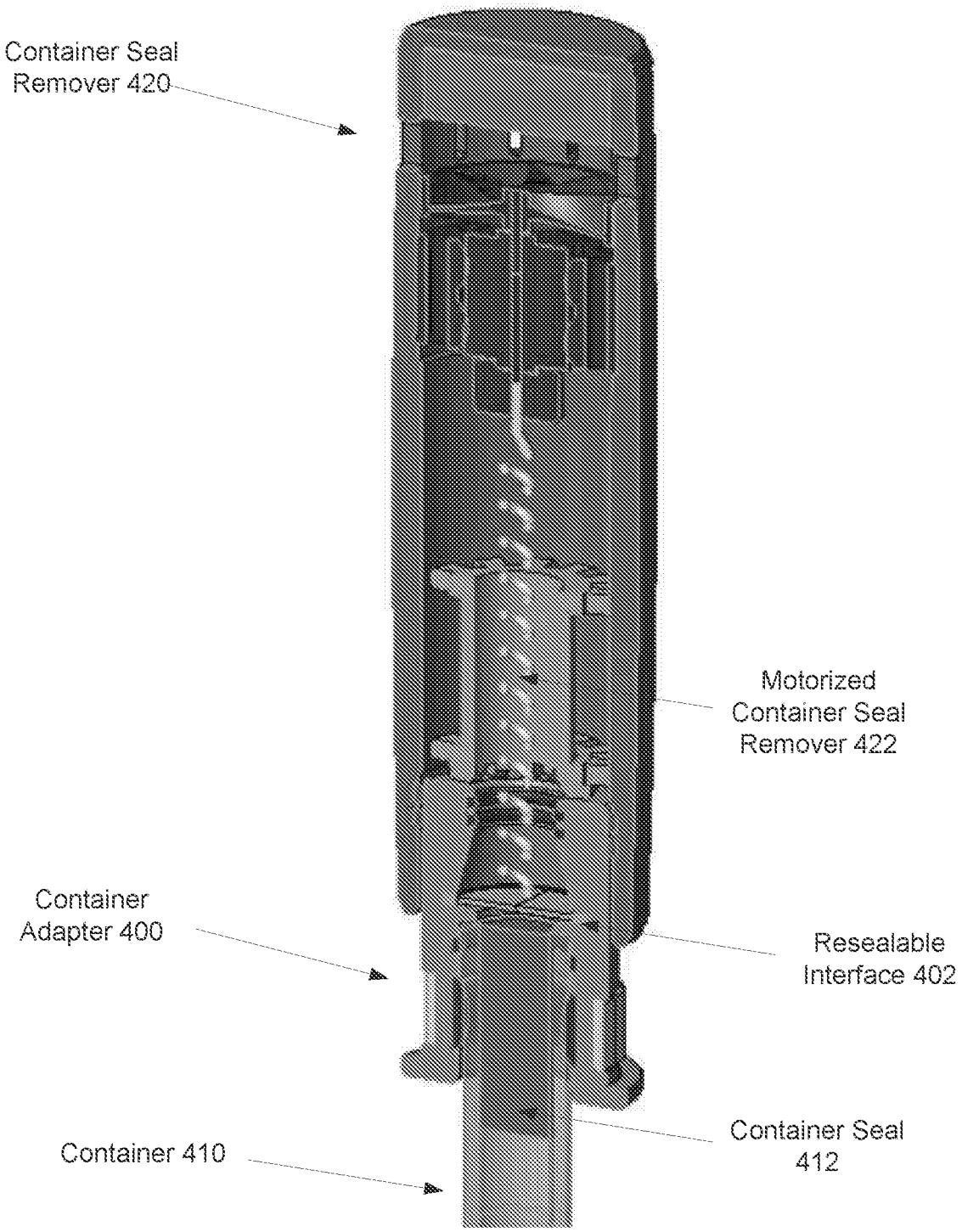
FIG. 4A shows a diagram of a container, a container adapter, and a container seal remover in accordance with one or more embodiments of the invention at a first point in time with a portion of the container, the container adapter, and the container seal remover removed.

FIG. 4A shows a diagram of a container adapter (400) attached to a container (410) and a container seal remover (420) attached to the container adapter (410). The container seal (412) has not yet been removed but the motorized container seal remover (422) and container seal (412) have been isolated from the ambient environment. The motorized container seal remover (422) is isolated from the container seal (412) by the resealable interface (402).

Figure 4B:
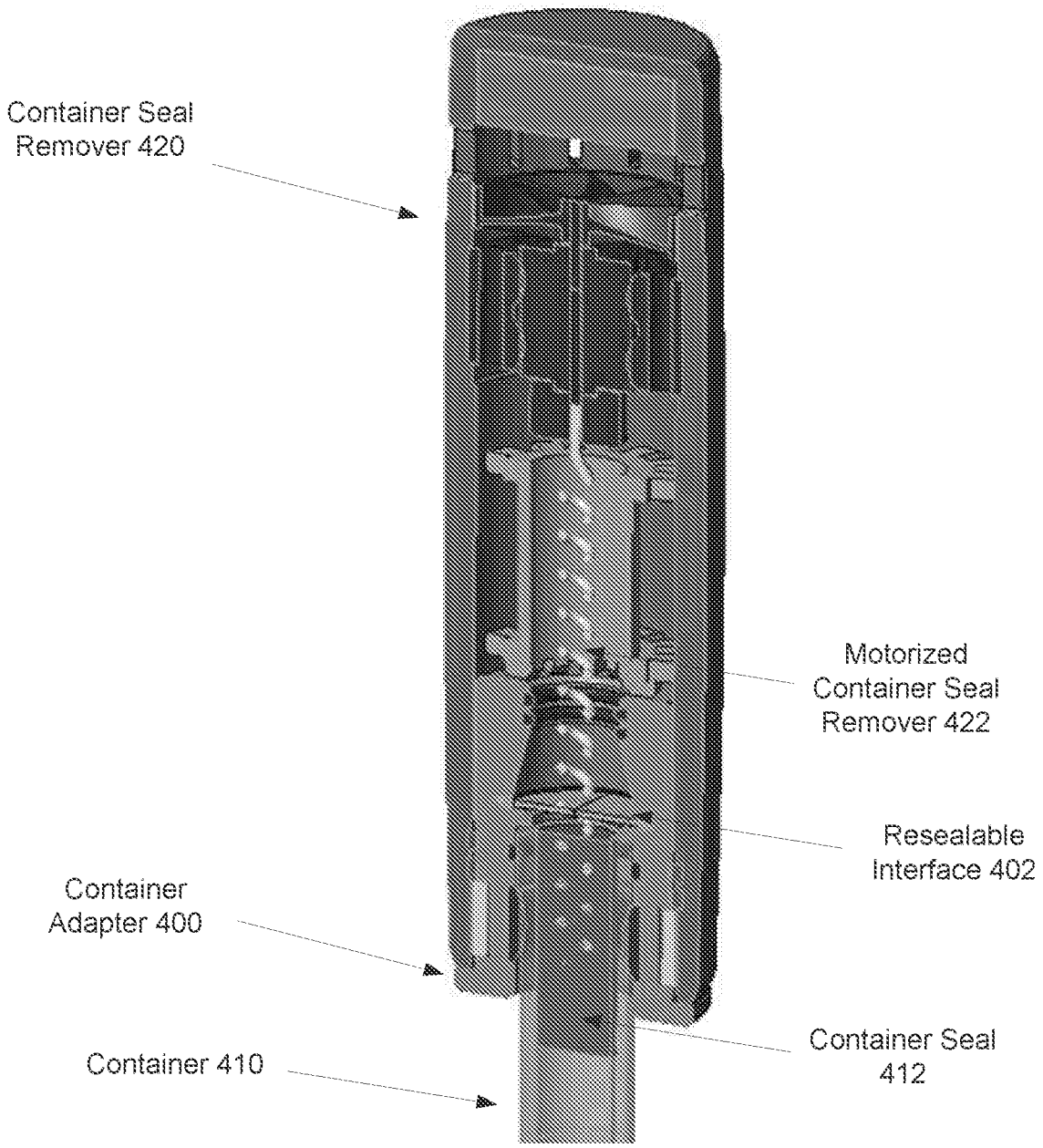
FIG. 4B shows a diagram of a container, a container adapter, and a container seal remover in accordance with one or more embodiments of the invention at a second point in time with a portion of the container, the container adapter, and the container seal remover removed.

FIG. 4B shows a diagram of a container adapter (400) attached to a container (410) and a container seal remover (420) attached to the container adapter (410) after the motorized container seal remover (422) is actuated to attach to the container seal (412). Specifically, the motorized container seal remover (422) has been actuated to penetrate through the resealable interface (402) and into the container seal (412). By virtue of being sealed from the ambient environment in this state, penetrating the container seal (412) and/or resealable interface (402) does not cause atmospheric gasses or other materials from being introduced into the container (410).

Figure 4C:
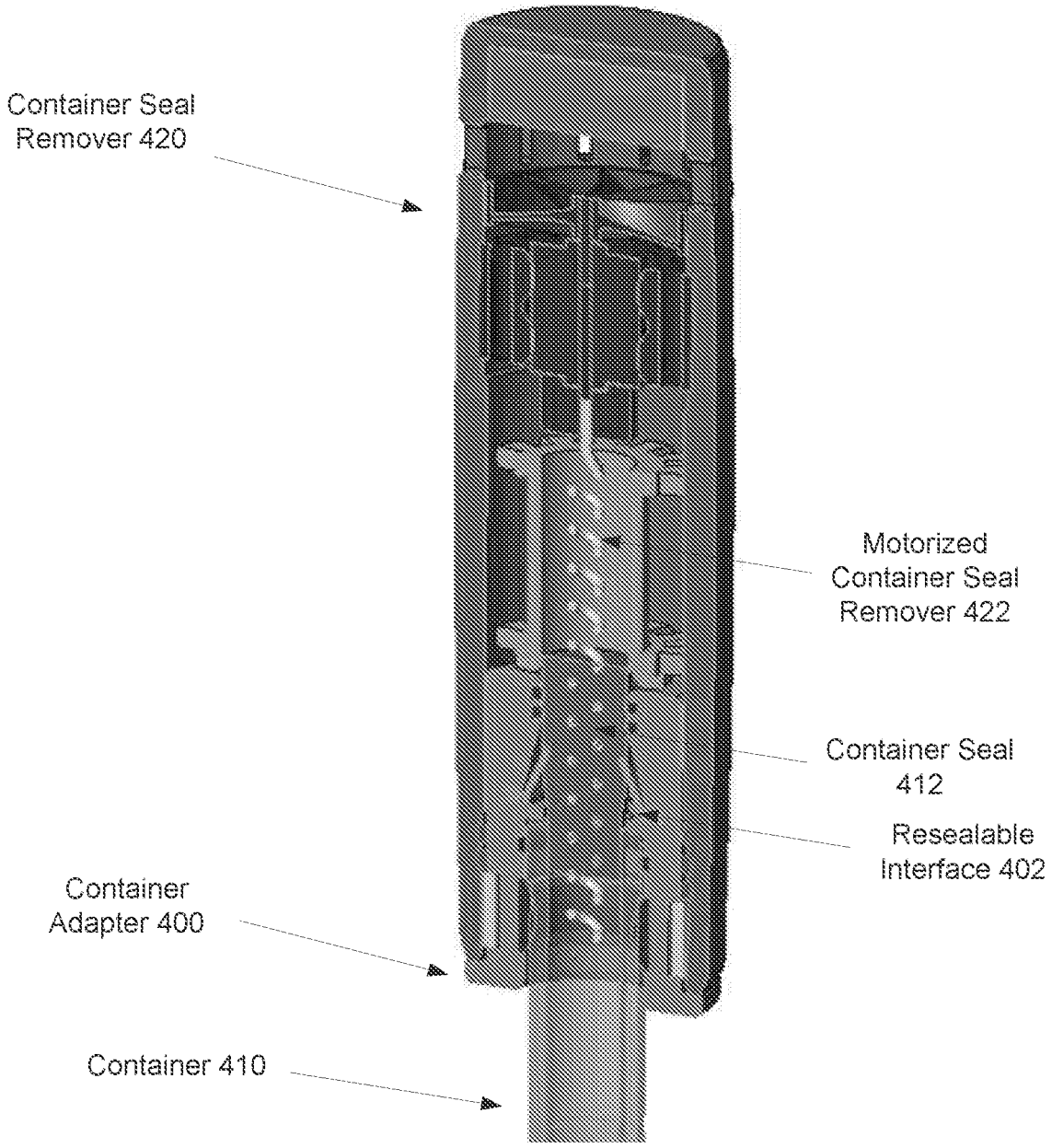
FIG. 4C shows a diagram of a container, a container adapter, and a container seal remover in accordance with one or more embodiments of the invention at a third point in time with a portion of the container, the container adapter, and the container seal remover removed.

FIG. 4C shows a diagram of a container adapter (400) attached to a container (410) and a container seal remover (420) attached to the container adapter (410) while the motorized container seal remover (422) removes the container seal (412). Specifically, as seen from FIG. 4C, the motorized container seal remover (422) has pulled the container seal (412) partially out of the container (410), partially through the resealable interface (402), and partially into the container seal remover (420). By virtue of being sealed from the ambient environment in this state, atmospheric gasses or other materials are not introduced into the container (410) while the container seal (412) is being extracted.

Figure 4D:
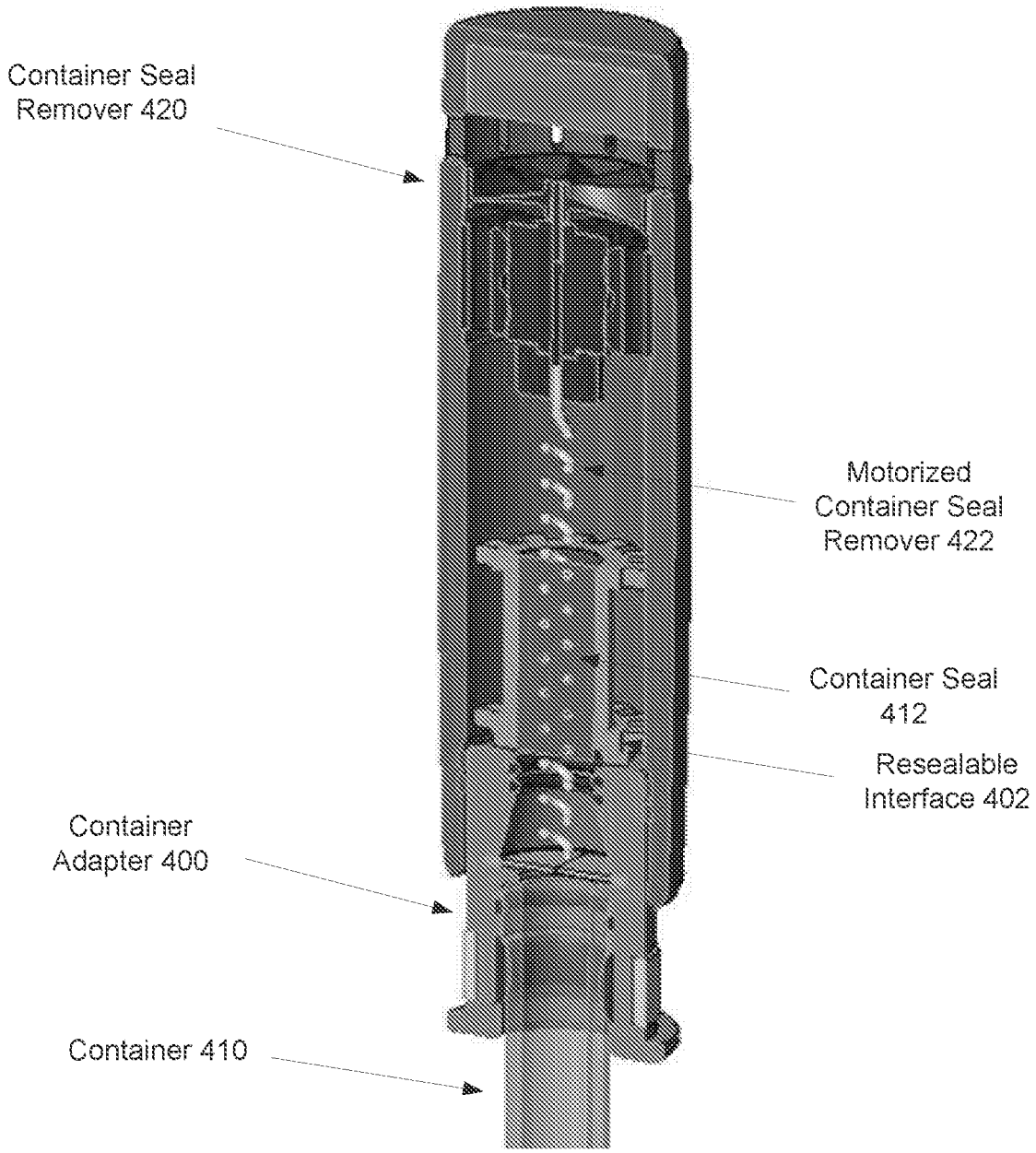
FIG. 4D shows a diagram of a container, a container adapter, and a container seal remover in accordance with one or more embodiments of the invention at a fourth point in time with a portion of the container, the container adapter, and the container seal remover removed.

FIG. 4D shows a diagram of a container adapter (400) attached to a container (410) and a container seal remover (420) attached to the container adapter (400) after the motorized container seal remover (422) has removed the container seal (412). As seen from FIG. 4D, after the container seal (412) is removed the resealable interface (402) reseals and thereby isolates the internal volume of the container (410) from the sealed compartment of the container seal remover (420) in which the container seal (412) is now disposed.

Thus, via the process illustrated in FIGS. 4A-4D, a container seal may be removed while reducing/preventing the introduction of atmospheric gasses or other materials into the container.

Figure 5A:
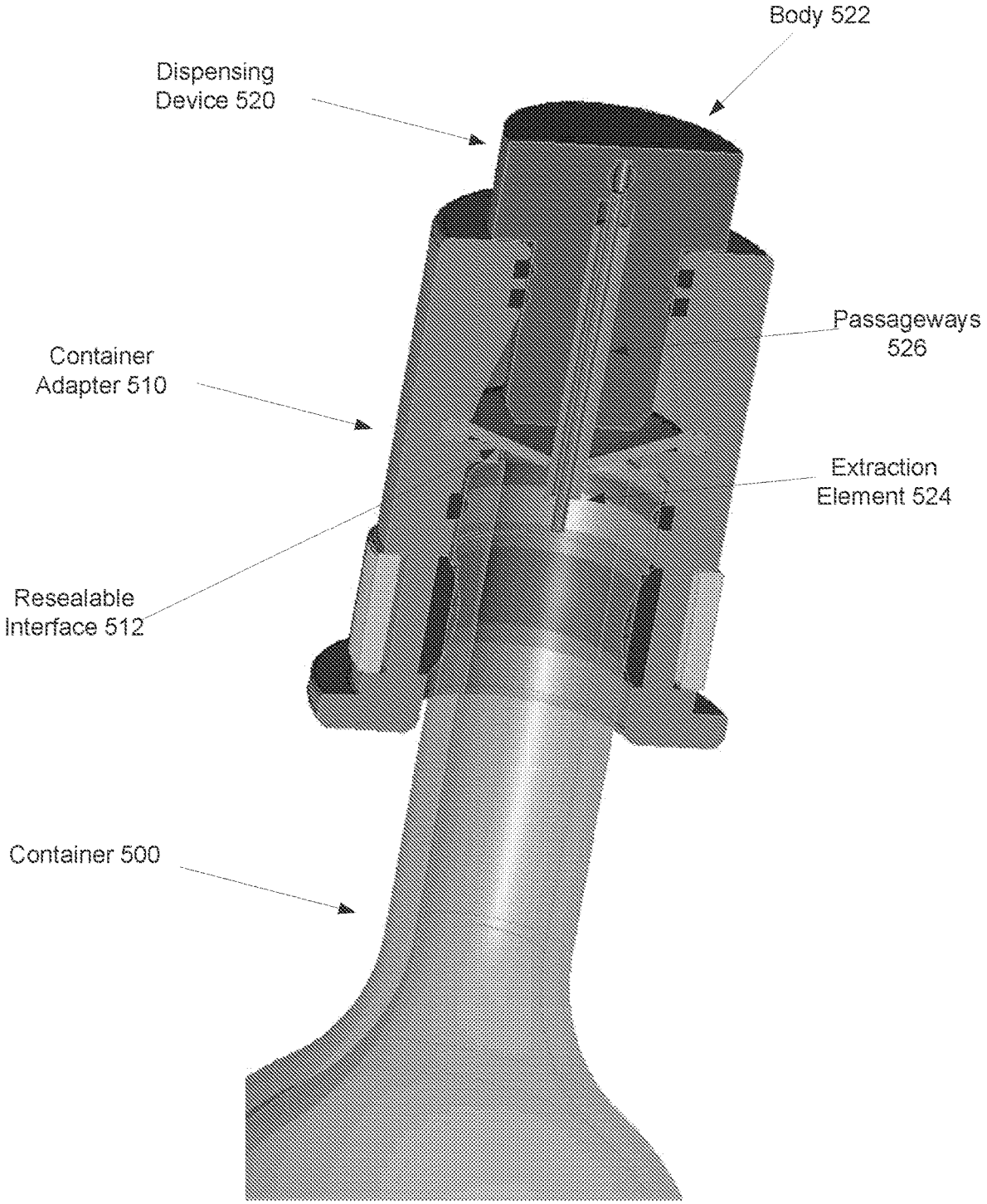
FIG. 5A shows a diagram of a container, a container adapter, and a dispensing device in accordance with one or more embodiments of the invention with a portion of the container, the container adapter, and the dispensing device removed.
Figure 5B:
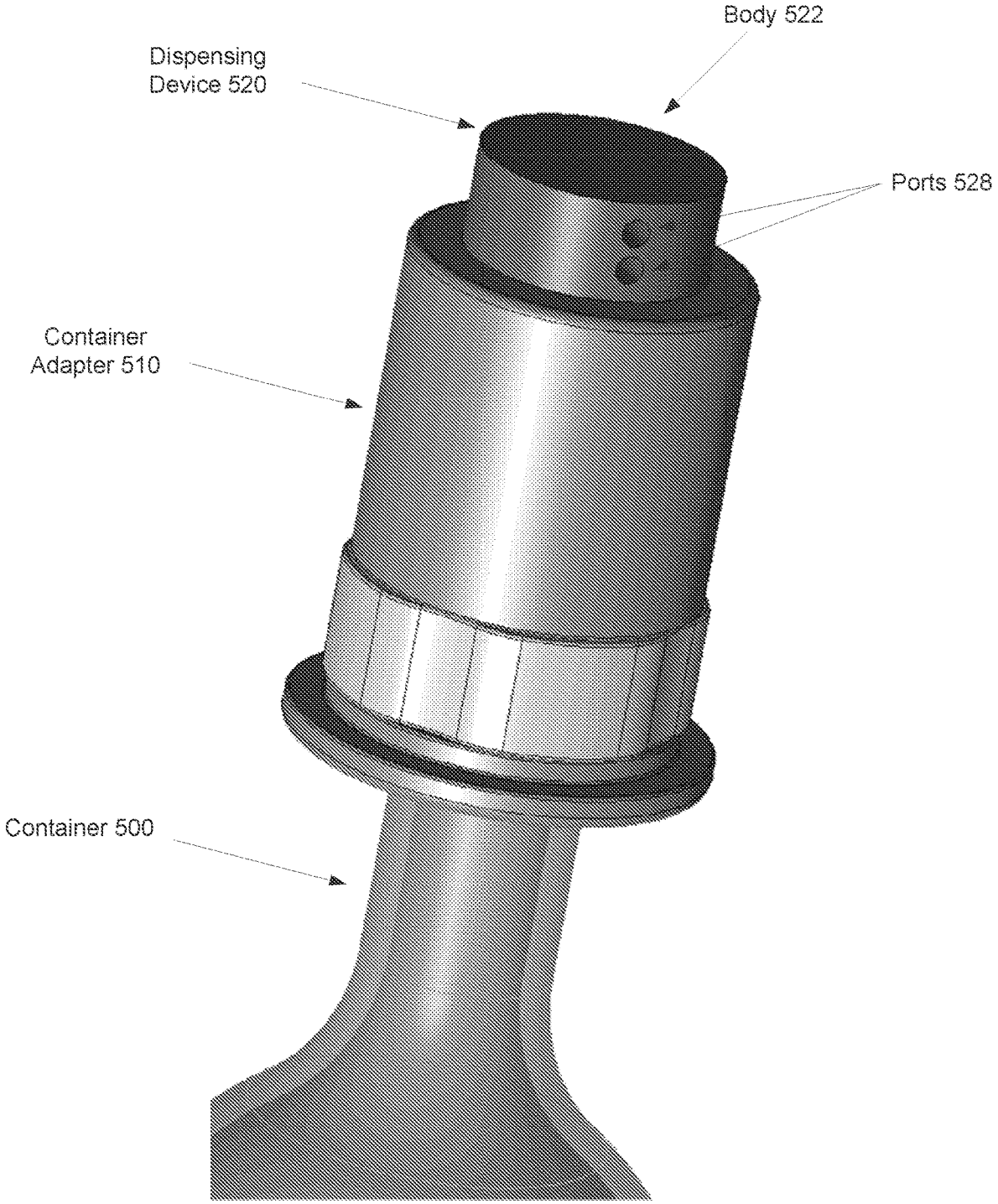
FIG. 5B shows a diagram of a container, a container adapter, and a dispensing device in accordance with one or more embodiments of the invention.

After attaching a container adapter and removing a container seal, the contents of a container may be extracted. For example, fluids disposed within the container may be removed. In some embodiments of the invention the contents of the container are removed by using a dispensing device, e.g., a physical device that extracts liquids from a container through a resealable interface. The dispensing device may be used in conjunction with a handheld dispenser, i.e., manually actuated, or an appliance, i.e., automatic, to manage the process of extracting a liquid from a container. FIGS. 5A-5B illustrate a fluid dispenser, FIGS. 6A-6E illustrate an appliance, and FIGS. 7A-7D illustrate a handheld dispenser in accordance with one or more embodiments of the invention.

FIG. 5A shows a diagram of a dispensing device (520) attached to a container adapter (510) in accordance with one or more embodiments of the invention. In FIG. 5A, a portion of the container adapter (510), container (500) and dispensing device (520) have been removed to illustrate internal portions of the aforementioned components.

In one or more embodiments of the invention, the dispensing device (520) is a physical structure for removal of the contents of the container (500) via the container adapter (510). The dispensing device (520) may enable the contents of the container (500) to be removed without exposing the contents in the container (500) to an ambient atmosphere or other material from the surrounding environment. The dispensing device (520) may include a body (522), extraction element (524) passageway (526), and ports (not shown, See FIG. 5B). Each component of the dispensing device (520) is discussed below.

In one or more embodiments of the invention, the body (522) is a physical structure. The body (522) may be made of a pliable material such as, for example, plastic or rubber. The body (522) may be made of other materials without departing from the invention.

In one or more embodiments of the invention, the body (522) has a shape that interlocks with the container adapter (510) to create a seal between the body (522) and the container adapter (510). The seal may isolate the resealable interface (512) from the ambient environment as part of the process of interlocking the body (522) with the container adapter. The shape may be, for example, a cylindrical shape having a diameter that is similar to a diameter of a chamber (e.g., 185, FIG. 1C) of the container adapter (510). The shape may be other shapes without departing from the invention.

In one or more embodiments of the invention, the extraction element (524) is a physical structure. The extraction element (524) may be made of a structural material such as, for example, metal. The extraction element (524) may be made of other materials without departing from the invention.

In one or more embodiments of the invention, the extraction element (524) is a needle that extends from the body (522) and/or into the body (522). For example, a first portion of the extraction element (524) may extend away from the body (522) and a second portion of the extraction element (524) may extend into the body (522). As part of the process of interlocking the body (522) with the container adapter (510), the extraction element (524) may penetrate through the resealable interface (512) after the seal between the body (522) and the container adapter (510) has been formed. By penetrating the resealable interface (512) after the seal has been formed, the contents of the container (500) may remain isolated from the ambient environment and/or reduce the likelihood of atmospheric gasses or other materials being introduced into the container (500) due to the penetration.

In one or more embodiments of the invention, the needle includes multiple channels. The channels may be, for example, tubular structures. The channels may have other shapes without departing from the invention. The multiple channels may enable simultaneous extraction/injection of gas/liquids into the container (500). Each channel may be hydraulically connected, separately, to respective apertures near a tip of the needle (or other portion of the needle that extends from the body (522)) and passageways (526).

In one or more embodiments of the invention, the passageways (526) are physical structures. The passageways (526) may be made of a structural material such as, for example, plastic or metal. The passageways (526) may be made of other materials without departing from the invention. The passageways (526) may be voids within the body (522).

In one or more embodiments of the invention, the passageways (526) are tubular shaped structures that form hydraulic connections between the channels of the extraction element (524) and the ports (not shown). Thus, the passageways (526) may form hydraulic connections between respective apertures of the extraction element (524) and the ports.

To further clarify the dispensing device (520), FIG. 5B shows the same diagram of FIG. 5B but includes the removed portion of each component. As seen from FIG. 5B, the ports (528) may be disposed on an exterior surface of the body (522). Thus, gasses/fluids may be injected/extracted from the interior of the container (500) via the ports (528).

As discussed above, the dispensing device and container adapter may be used in conjunction with other types of devices to remove the contents of a container while preserving the remaining contents in the container. FIGS. 6A-6E show an example of an appliance and FIGS. 7A-7E show an example of a handheld dispenser.

Figure 6A:
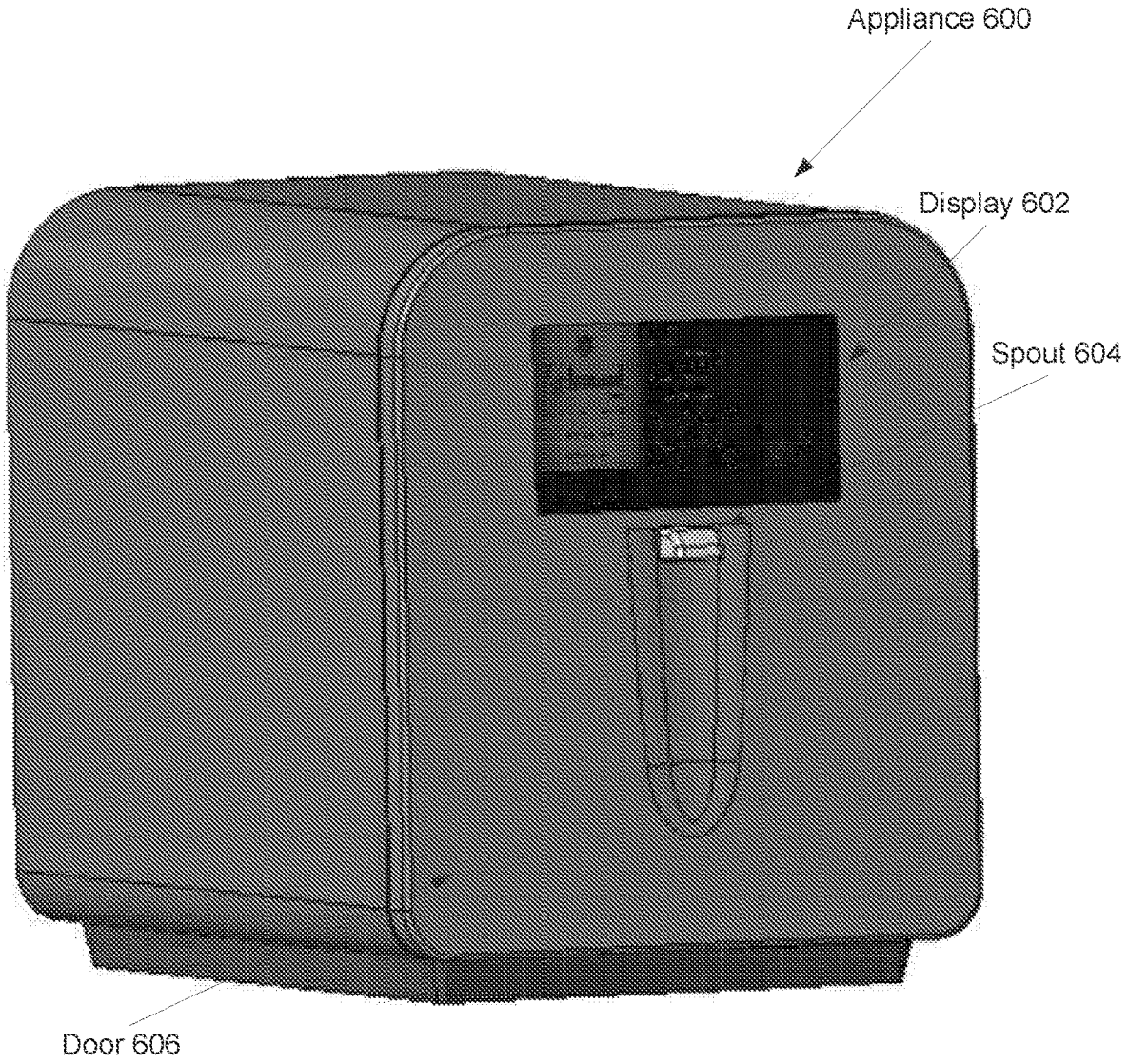
FIG. 6A shows a diagram of an appliance in accordance with one or more embodiments of the invention.

FIG. 6A shows a diagram of an appliance (600) in accordance with one or more embodiments of the invention. The appliance (600) may be a physical device that automates the process of removing liquid from a container. The appliance (600) may include a door (606) that may be opened to enable containers to be placed within an interior of the appliance (600). For additional details regarding the interior of the appliance (600), See FIGS. 6B-6D.

The appliance (600) may include a spout (604) that may dispense fluids extracted from containers disposed within the appliance (600). For additional details regarding components of the appliance that facilitate the dispensing of fluids, See. FIG. 6E.

The appliance may include a touch sensitive display (602) that may display a graphic user interface (GUI) by which a user may control the operation of the appliance (600). The GUI may display interactive menus by which the user may be presented options and by which the user may initiate functions of the GUI. Additionally, the GUI may display information related to containers disposed within the appliance (600) or containers not disposed within the appliance (600). For example, the GUI may display labels, or other identification information, that enables a user to identify containers disposed within the appliance (600). In another example, the GUI may display labels, or other identification, of containers not disposed in the appliance (600). By displaying the information related to other containers, the user may be informed of other types of containers not possessed by the user.

In one or more embodiments of the invention, the appliance includes functionality (600) to regulate a temperature of a liquid in a container when the container is disposed in the appliance. Thus, the appliance may chill and/or warm fluids to desired serving temperatures.

In one or more embodiments of the invention, the appliance (600) includes functionality to identify when container adapters are first affixed to containers. For example, the appliance (600) may be operably connected to a data repository that tracks when container adapters (652) are affixed to containers (650). Alternatively, the container adapters (652) may include functionality to identify when they have been a fixed to a container and may relay such information to the appliance when placed inside the appliance. For example, the container adapters (652) may include a low power transceiver, sensor, and a memory. The sensor may identify when the container adapters are affixed to a container and store a record of that time in memory. When the container adapter is placed in an appliance, the container adapter may forward the record to the appliance from the memory. In this manner, the appliance (600) may identify when a container adapter is first affixed to a container. The appliance (600) may then relay this information to a repository stored on a remote computing device for distribution to other appliances.

In one or more embodiments of the invention, the appliance, or another entity operably connected to the appliance or the computing device hosting the repository, may notify a user of when a liquid contained in the containers (650) should be consumed based on the date on which the container adapters (652) were affixed to the containers (650). By doing so, embodiments of the invention may provide a system that reduces the likelihood of spoilage of liquids included in containers (e.g., 650). The notifications to the users may be set on a schedule based on the type of the liquid and the date that the container adapter was affixed to a container.

While not illustrated in FIG. 6A, the appliance (600) may include a computing device that orchestrates the operation of the appliance. For details regarding a computing device, See FIGS. 8A-8C.

Figure 6B:
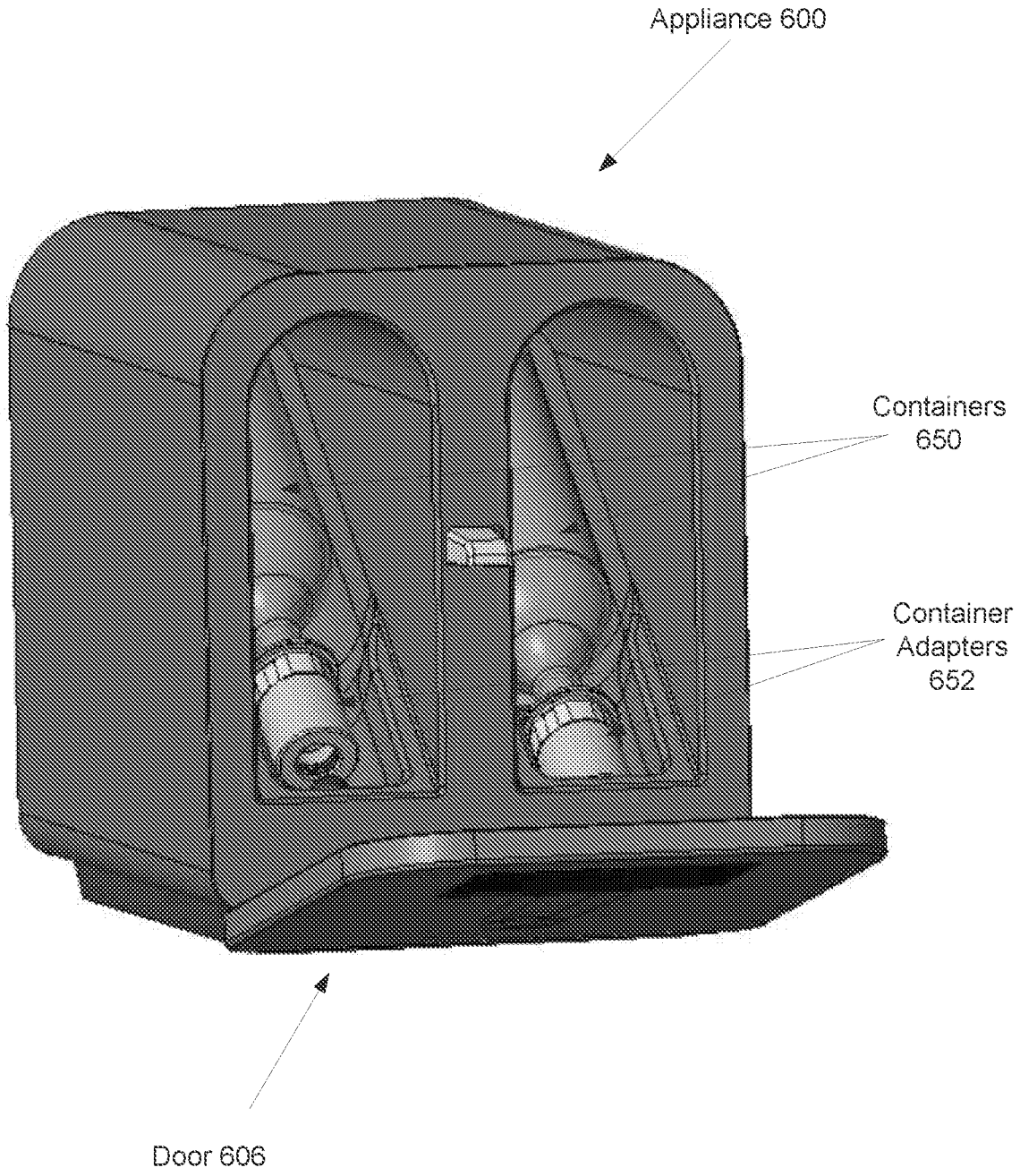
FIG. 6B shows a diagram of an appliance, containers, and container adapters in accordance with one or more embodiments of the invention.

FIG. 6B shows a diagram of an appliance (600) in accordance with one or more embodiments of the invention. In FIG. 6B, the door of the appliance is open. As seen from FIG. 6B, containers (650) having container adapters (652) attached are disposed within the appliance (600). The container adapters (652) may be adapted for heating and chilling by the appliance. For example, the construction of the container adapters (652) may enable them to expand and contract in response to temperature changes without negatively impacting the ability of the appliance to remove fluid through them and continue to prevent atmospheric gasses from interacting with fluids disposed in the containers (650). As will be discussed with respect to FIGS. 6C-6E, the appliance (600) may include components that enable the removal of fluids from the containers (650) while preventing/limiting the expose of the contents of the containers (650) to the ambient atmosphere or other materials from the local environment surrounding the containers (650).

Figure 6C:
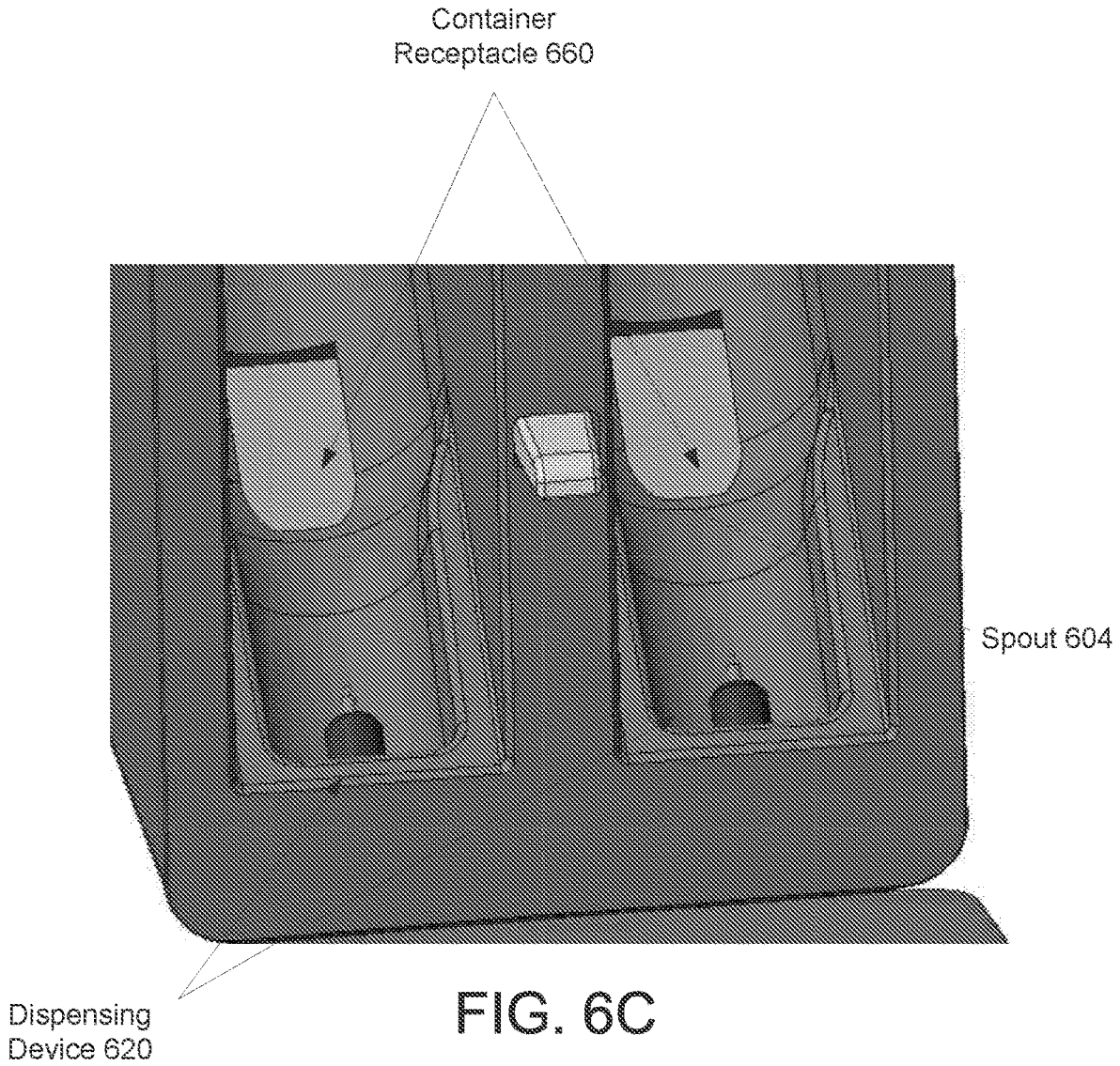
FIG. 6C shows a diagram of an appliance and dispensing devices in accordance with one or more embodiments of the invention.

FIG. 6C shows a diagram of an appliance (600) in accordance with one or more embodiments of the invention. In FIG. 6C, the containers and container adapters shown in FIG. 6B have been removed. As seen in FIG. 6C, the interior of the appliance (600) includes container receptacles (660) for receiving containers. The container receptacles (660) may be physical devices for holding containers. The container receptacles (660) may have a shape that is complimentary to a shape of a container. For example, the container receptacles (660) may have a cylindrical shape that is similar to the cylindrical shape of containers.

In one or more embodiments of the invention, each of the container receptacles (660) may include corresponding dispensing devices (620). The dispensing devices (620) may be similar to the dispensing device (620) shown in FIGS. 5A-5B. Each of the dispensing devices (620) may be disposed at a bottom of a corresponding container receptacle. As used herein, a bottom of a corresponding container receptacle means a location within the container receptacle (660) to which gravity would cause a container disposed within the container receptacle to move toward when the appliance (600) is in an orientation for which it is designed to be placed while in operation.

In one or more embodiments of the invention, the container receptacles (660) are hydraulically connected to a gas supply (not shown) and the spout (604). The appliance (600) may cause the gas supply to dispense gas into a container via a dispensing device (e.g., 620). Dispensing gas into the container may cause liquid to flow out of the container via the dispensing device, through fluid lines (not shown), and to be dispensed out of the spout (604). For additional details regarding dispensing of fluids, See FIG. 6E.

Figure 6D:
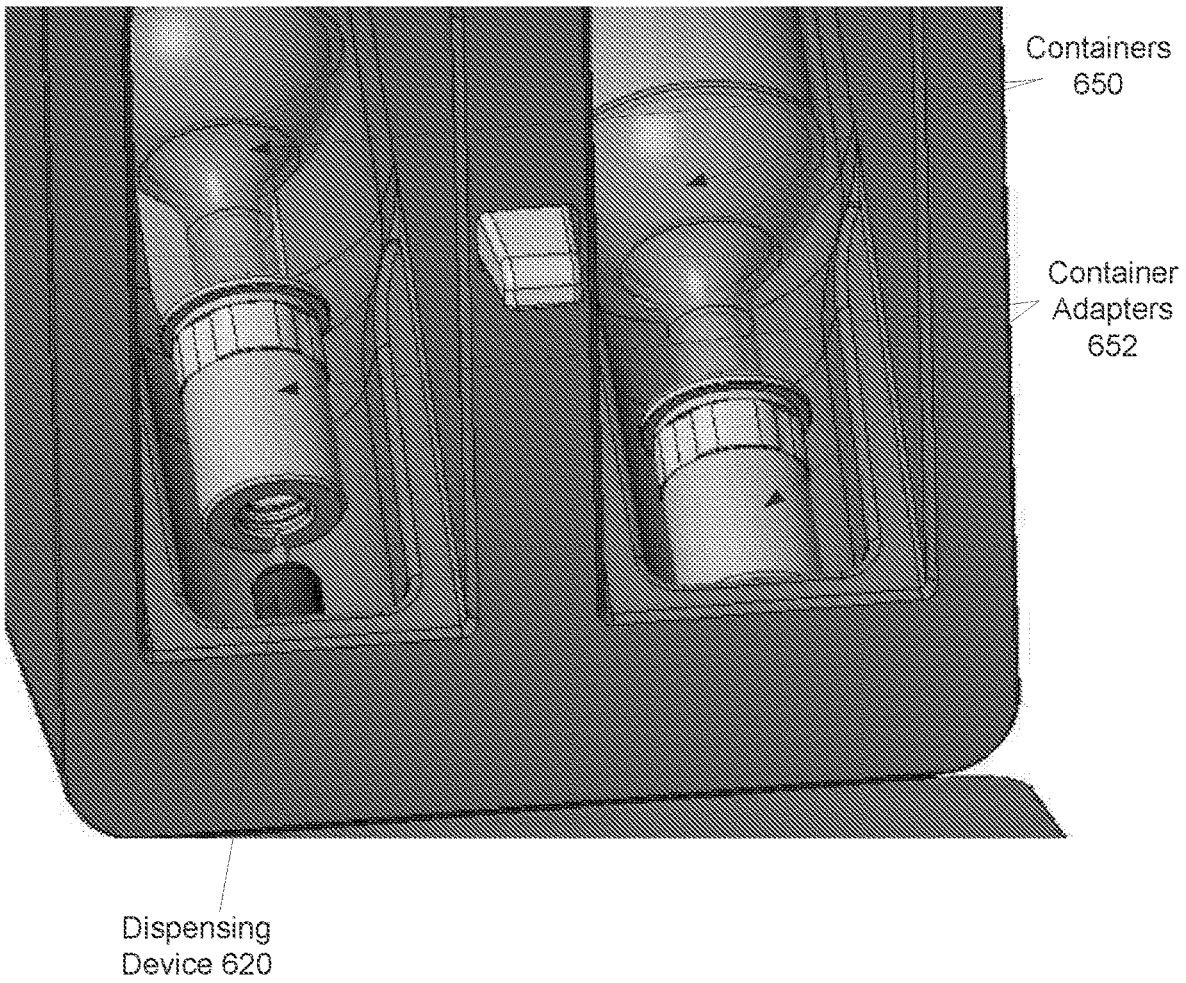
FIG. 6D shows a diagram of an appliance, dispensing devices, containers, and container adapters in accordance with one or more embodiments of the invention.
Figure 6E:
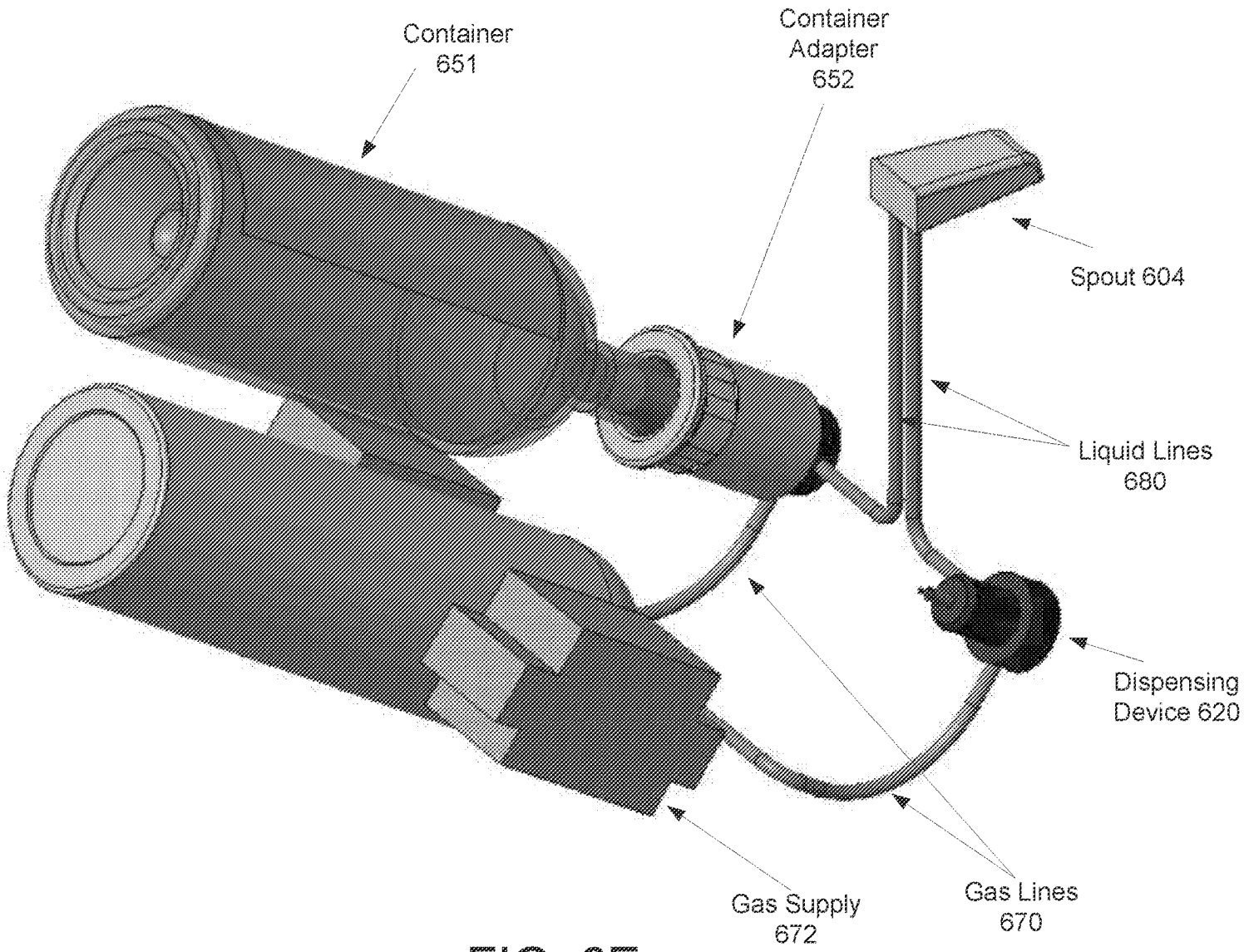
FIG. 6E shows a diagram of a portion of the components of the appliance in accordance with one or more embodiments of the invention.

FIG. 6D shows a diagram of an appliance (600) in accordance with one or more embodiments of the invention. In FIG. 6D, a container and container adapter (left container) are shown in the process of insertion into a container receptacle. As seen in FIG. 6D, the container is first inserted into an upper portion of the container receptacle and is then translated downward along the container receptacle until the container adapter engages with a dispensing device (e.g., 620). The container illustrated on the left in FIG. 6D shows a state of the container before translation and engagement with a dispensing device and the container illustrated on the right in FIG. 6D shows the state of the container after translation and engagement with a dispensing device. The container to the right in FIG. 6D is in a state where a gas may be dispensed into the container and thereby may cause a liquid disposed within the container to be dispensed.

FIG. 6E shows a diagram of a portion of the components of an appliance in accordance with one or more embodiments of the invention. For clarity, FIG. 6E shows the system of FIG. 6D with one of the containers (650) removed. The portion of the components of the appliance may enable fluids within one of the containers (651) to be dispensed via the spout (604). The portion of the components include a gas supply (672) hydraulically connected to dispensing devices (620). The dispensing device (620) are hydraulically connected to the spout. Thus, a gas may be dispensed from the gas supply (672) into the container (651) via the gas lines (670) and dispensing devices (620) while the container adapter (652) is engaged with the dispensing device (620), e.g., operate as an atmospheric regulator. In response to dispensing of gas into the container (651), the pressure within the container (651) may increase and cause fluid within the container (651) to be dispensed out of the spout (604) via the dispensing device (620) and liquid lines (680). For example, as discussed with respect to FIGS. 5A and 5B, the dispensing device (620) may include an extraction element that includes multiple channels. Accordingly, gas may be injected via a first channel and a liquid within the container may be extracted via a second channel simultaneously.

While components of the appliance (600) have been described in FIGS. 6A-6E, the appliance (600) may include other components without departing from the invention. For example, the appliance (600) may include one way valves, ball valves, actuators, sensors, heating/cooling units, and/or sensors for monitoring the dispensing of wine and/or preservation of the liquid in containers disposed within the appliance (600).

As discussed above, a dispensing device and container adapter may be used in conjunction with a handheld dispenser. FIGS. 7A-7E show a handheld dispenser in accordance with one or more embodiments of the invention.

Figure 7A:
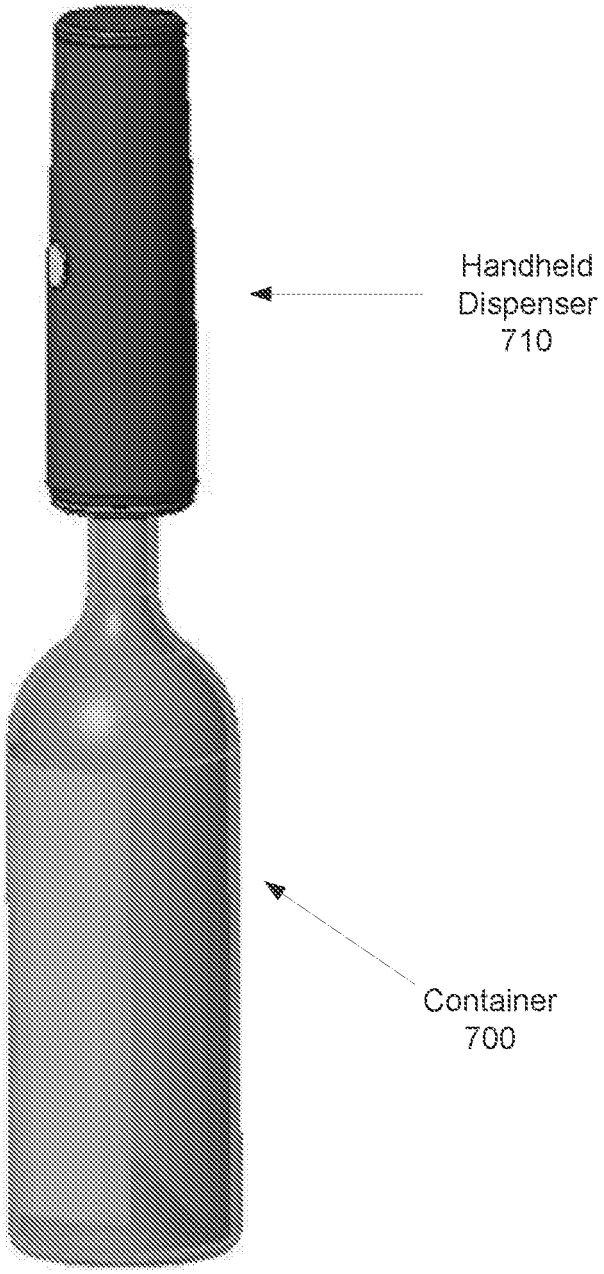
FIG. 7A shows a diagram of a handheld dispenser and a container in accordance with one or more embodiments of the invention.

FIG. 7A shows a diagram of a handheld dispenser (710) in accordance with one or more embodiments of the invention. The handheld dispenser (710) may be a physical device that enables removal of liquid from a container while preventing and/or reducing the introduction of an ambient atmosphere and/or other materials from the local environment into the container. In FIG. 7A, the handheld dispenser (710) is illustrated in a configuration where it is attached to a container (700). In such a configuration, the handheld dispenser (710) may dispense a liquid from the bottle by: (i) orienting the container (700) so that the liquid in the container is directly adjacent to a container seal, i.e., turn the container seal side down, and (ii) activating the handheld dispenser (710).

Figure 7B:
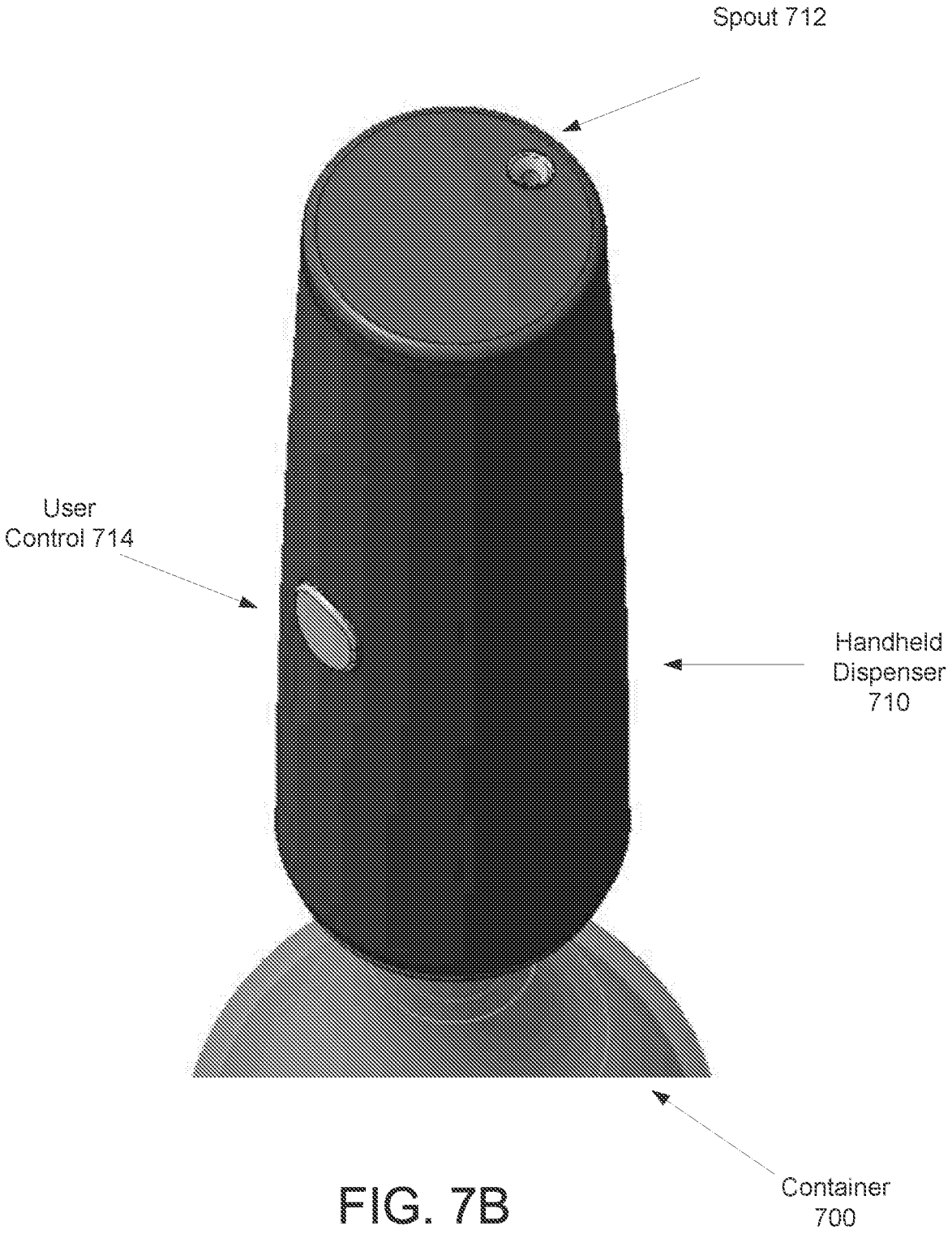
FIG. 7B shows a second diagram of a handheld dispenser and a container in accordance with one or more embodiments of the invention.

FIG. 7B shows a second diagram of the handheld dispenser (710) in accordance with one or more embodiments of the invention. In FIG. 7B, the view point has been shifted, when compared to the view point in FIG. 7A, to illustrate other components of the handheld dispenser (710). The handheld dispenser (710) may include a spout (712) for dispensing of liquid. As will be discussed with respect to FIGS. 7C-7E, the spout (712) may be hydraulically connected to a container (700) and thereby enable a liquid disposed within the container to be dispensed.

The handheld dispenser (710) may also include one or more user controls for initiating functions of the handheld dispenser (710). For example, the handheld dispenser (710) may include a user control (714) in the form of one or more buttons disposed on an exterior surface of the handheld dispenser (710). Pressing the one or more buttons may initiate one or more functions of the handheld dispenser (710).

Figure 7C:
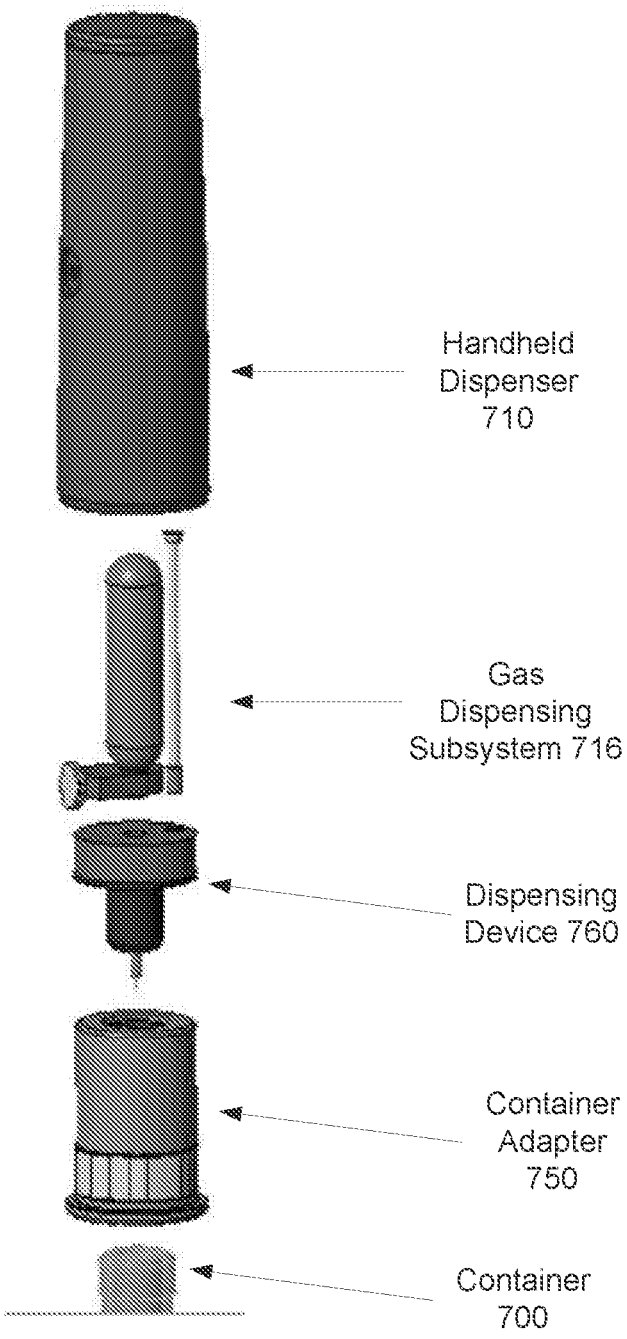
FIG. 7C shows an exploded diagram of a handheld dispenser, a container, a container adapter, and a dispensing device in accordance with one or more embodiments of the invention.

FIG. 7C shows an exploded diagram of the system shown in FIG. 7A. As seen from FIG. 7C, the system may include the handheld dispenser (710). The handheld dispenser (710) may include a gas dispensing subsystem (716), e.g., an atmospheric regulator. For additional details regarding the gas dispensing subsystem (716), See FIG. 7C.

The system may also include a dispensing device (760). The dispensing device (760) may be similar to the dispensing device shown in FIGS. 5A-5B.

The system may also include a container adapter (750). The container adapter (750) may be similar to the container adapter illustrated in FIGS. 1A-1D.

Each of the aforementioned components may be attached to each other in the ordered illustrated in FIG. 7C. For example, the container adapter (750) may be attached to the container (700). The dispensing device (760) may be attached to the container adapter (750). The handheld dispenser (710) may be attached to the dispensing device (760). In such a configuration, the system may enable a liquid disposed in the container to be extracted without introducing/limiting the introduction of the ambient atmosphere or other materials in the local environment into the container (700).

Figure 7D:
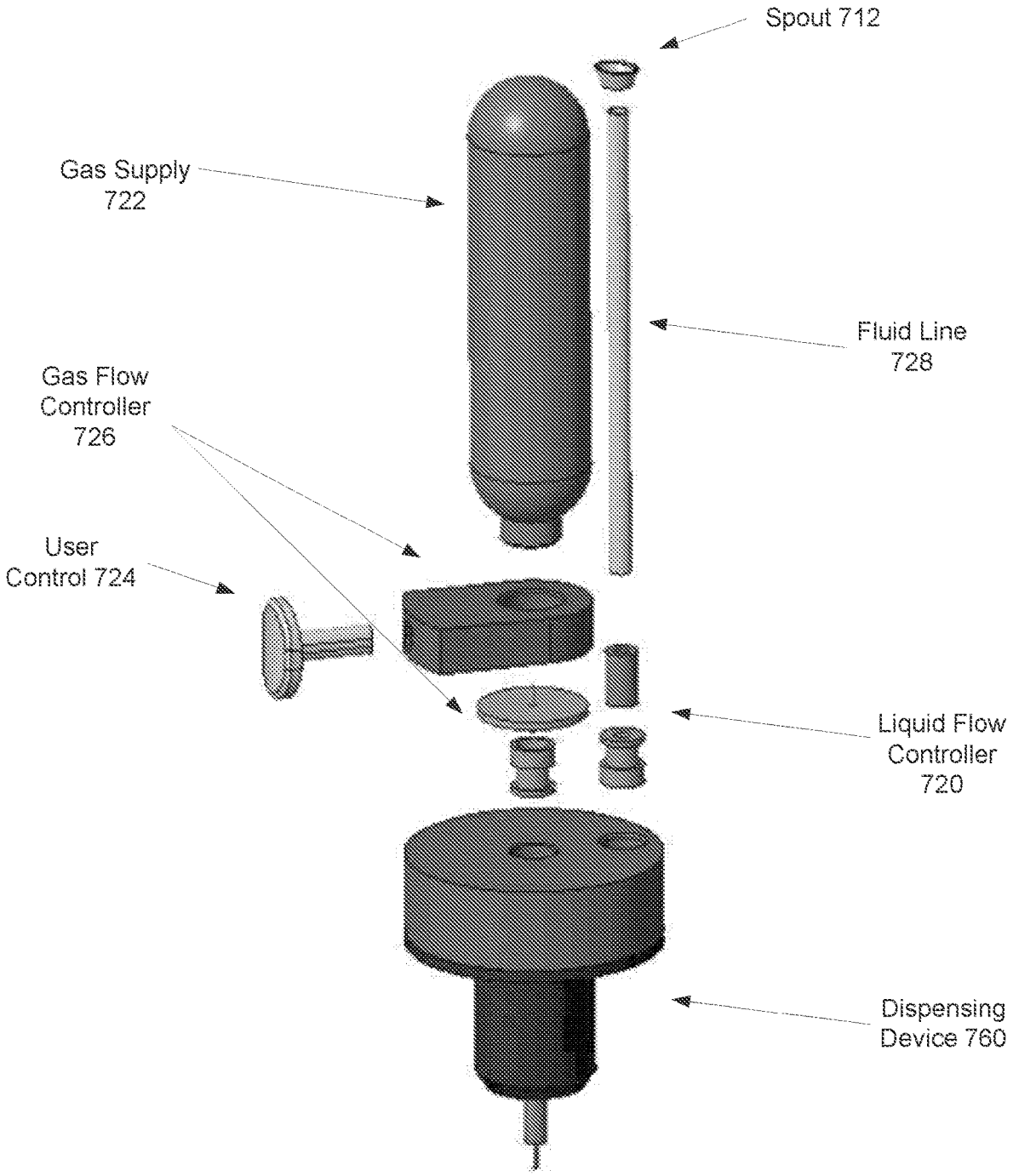
FIG. 7D shows an exploded diagram of a gas dispensing subsystem of a handheld dispenser in accordance with one or more embodiments of the invention.

FIG. 7D shows an exploded diagram of the gas dispensing subsystem (716) shown in FIG. 7C. The gas dispensing subsystem (716) may enable a gas to be injected into the container (not shown) via the dispensing device (760) and direct liquid in the container to a spout (712). The gas dispensing subsystem (716) may include a gas supply (722), user controls (724), a gas flow controller (726), a liquid flow controller (720), and a fluid line (728). Each component of the gas dispensing subsystem (716) is discussed below.

In one or more embodiments of the invention, the gas supply (722) is a physical device that supplies gas. The gas may be different from gasses in an ambient environment. For example, the gas may be argon or nitrogen. The gas may be other gasses without departing from the invention. In one or more embodiments of the invention, the gas supply (722) is a bottle that includes the gas. The gas in the bottle may be under pressure. The bottle may be replaceable and thereby enable the gas supply (722) to be replenished. The gas supply (722) may be other structures without departing from the invention.

In one or more embodiments of the invention, the user control (724) is a physical device that causes gas to be dispensed from the gas supply (722) when a user actuates the user control (724). The user control (724) may be, for example, a button. In one or more embodiments of the invention, the user control (724) is operably connected to the gas flow controller (726) and causes the gas flow controller (726) to enable gas to flow through the gas flow controller (726) when the user control (724) is actuated by a user.

In one or more embodiments of the invention, the gas flow controller (726) is a physical device that regulates the flow of gas from the gas supply (722) to the dispensing device (760). The gas flow controller (726) may be, for example, a valve. The gas flow controller (726) may include sensors or other detection components that may measure the flow of gas. The gas flow controller (726) may be other types of devices that regulate the flow of gas without departing from the invention.

In one or more embodiments of the invention, the gas flow controller (726) is hydraulically connected to the gas supply (722) and the dispensing device (760). While illustrated in FIG. 7C as being directly connected, the gas flow controller (726) may be hydraulically connected to the gas supply (722) and the dispensing device (760) through other component (not shown) without departing from the invention.

In one or more embodiments of the invention, the liquid flow controller (720) is a physical device that regulates the flow of liquid from the dispensing device (760) to the spout (712). The liquid flow controller (720) may be, for example, a valve. The valve may be a ball valve that prevents liquid from flowing when a pressure in the container is close to or less than the pressure in the ambient environment. In other words, the liquid flow controller (720) may only enable the flow of liquid through it when the pressure in the container is greater than the ambient pressure. The liquid flow controller (720) may include a spring, or other device, that controls the minimum pressure differential between the pressure in the container and an ambient pressure that cause the liquid flow controller (720) to enable liquid to flow. The spring, or other device, may be adapter to control the differential so that inadvertent flows of liquid through the liquid flow controller (720) are prevented/reduce the likelihood of occurring.

The liquid flow controller (720) may include sensors or other detection components that may measure the flow of liquid. The liquid flow controller (720) may be other types of devices that regulate the flow of liquid without departing from the invention.

In one or more embodiments of the invention, the gas flow controller (726) is hydraulically connected to the dispensing device (760) and a fluid line (728). The fluid line (728) may be hydraulically connected to the spout (712). While illustrated in FIG. 7C as being directly connected, the gas flow controller (726) may be hydraulically connected to the dispensing device (760) and the fluid line (728) through other component (not shown) without departing from the invention.

Figure 7E:
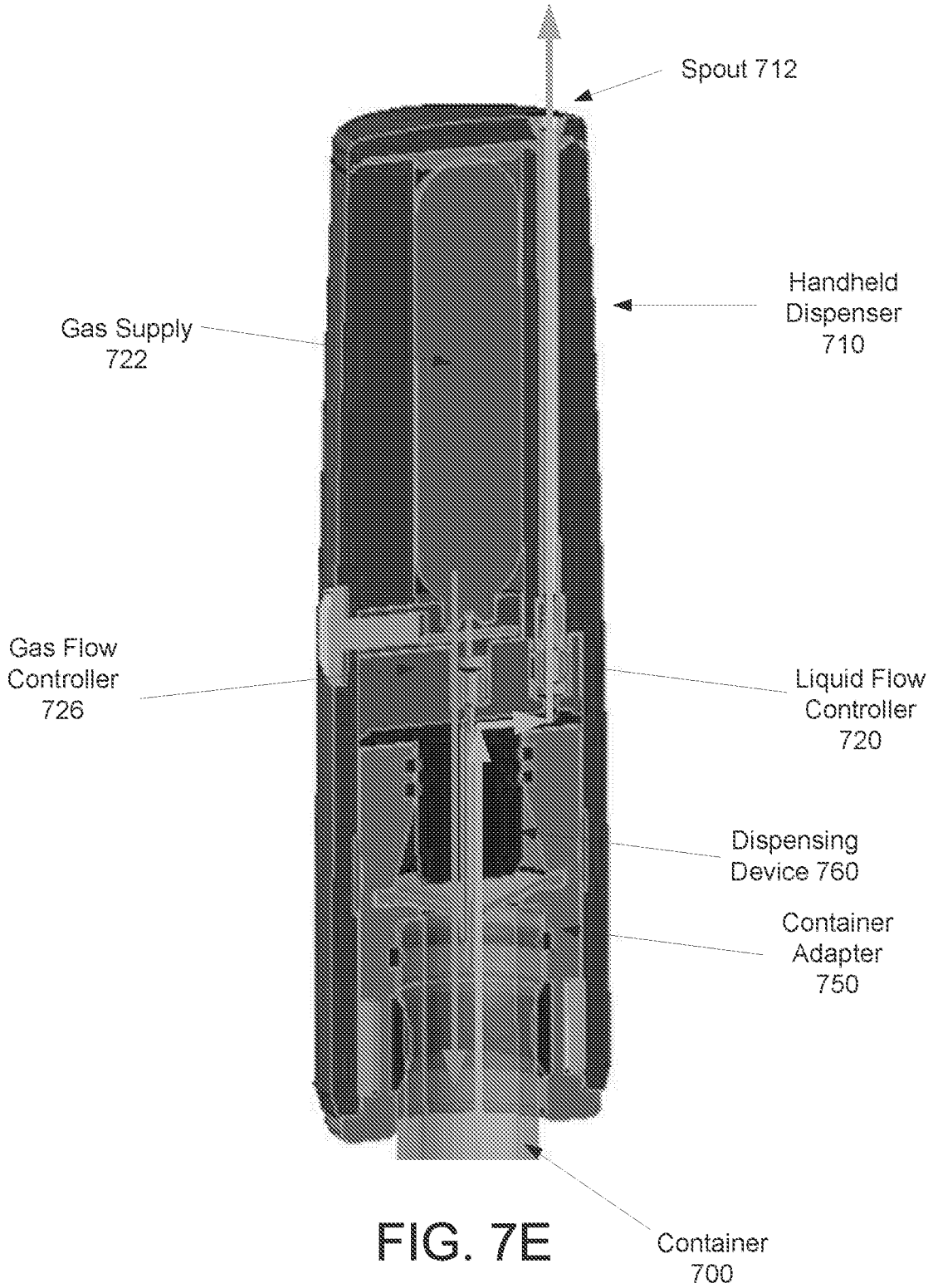
FIG. 7E shows a diagram of a handheld dispenser in accordance with one or more embodiments of the invention.

FIG. 7E shows a diagram of the handheld dispenser (710) shown in FIG. 7A. In FIG. 7E, a portion of the handheld dispenser (710), the dispensing device (760), the container adapter (750), and the container (700) have been removed to illustrate internal portions of the aforementioned components. Additionally, the flow of a gas has been illustrated by super imposing a red arrow along the gas flow path and the flow of a liquid has been illustrated by superimposing blue arrows along the liquid flow path. For the sake of brevity and clarity, reference numerals for some of the portions of the aforementioned components have not been included.

As seen from FIG. 7E, the gas flows from the gas supply (722), through the gas flow controller (726), through the dispensing device (760), through the container adapter (750), and into the container (700). The liquid from the container (700), through the container adapter (750), through the dispensing device (760), through the liquid flow controller (720), and out of the spout (712).

Figure 8A:
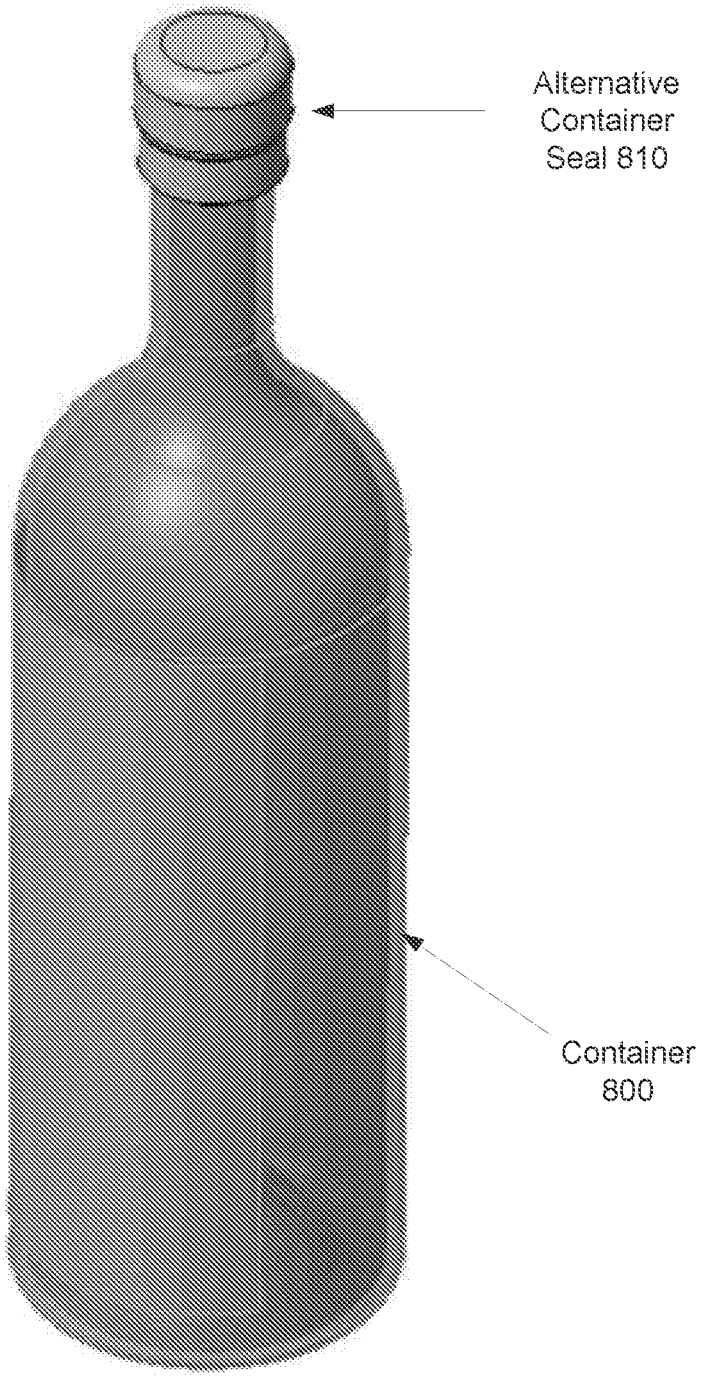
FIG. 8A shows a diagram of a container and an alternative container seal in accordance with one or more embodiments of the invention.
Figure 8B:
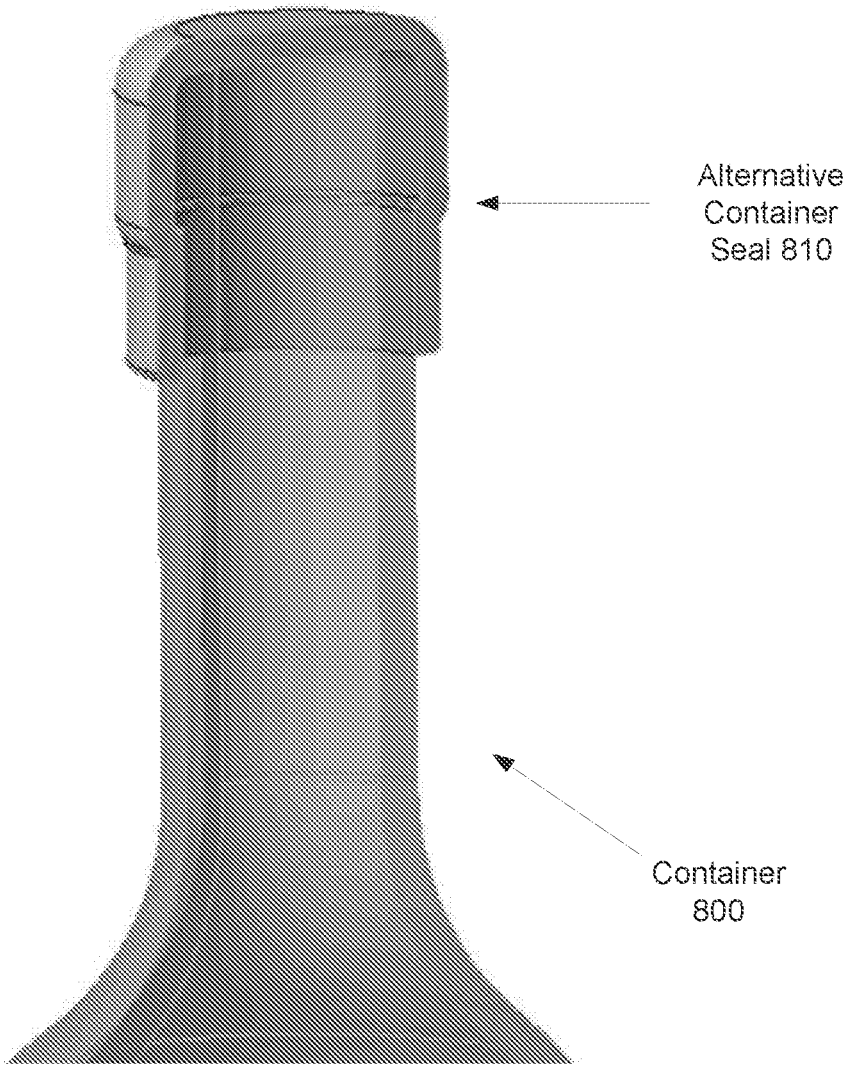
FIG. 8B shows a diagram of a container and an alternative container seal in accordance with one or more embodiments of the invention with a portion of the container and the alternative container seal removed.
Figure 8C:
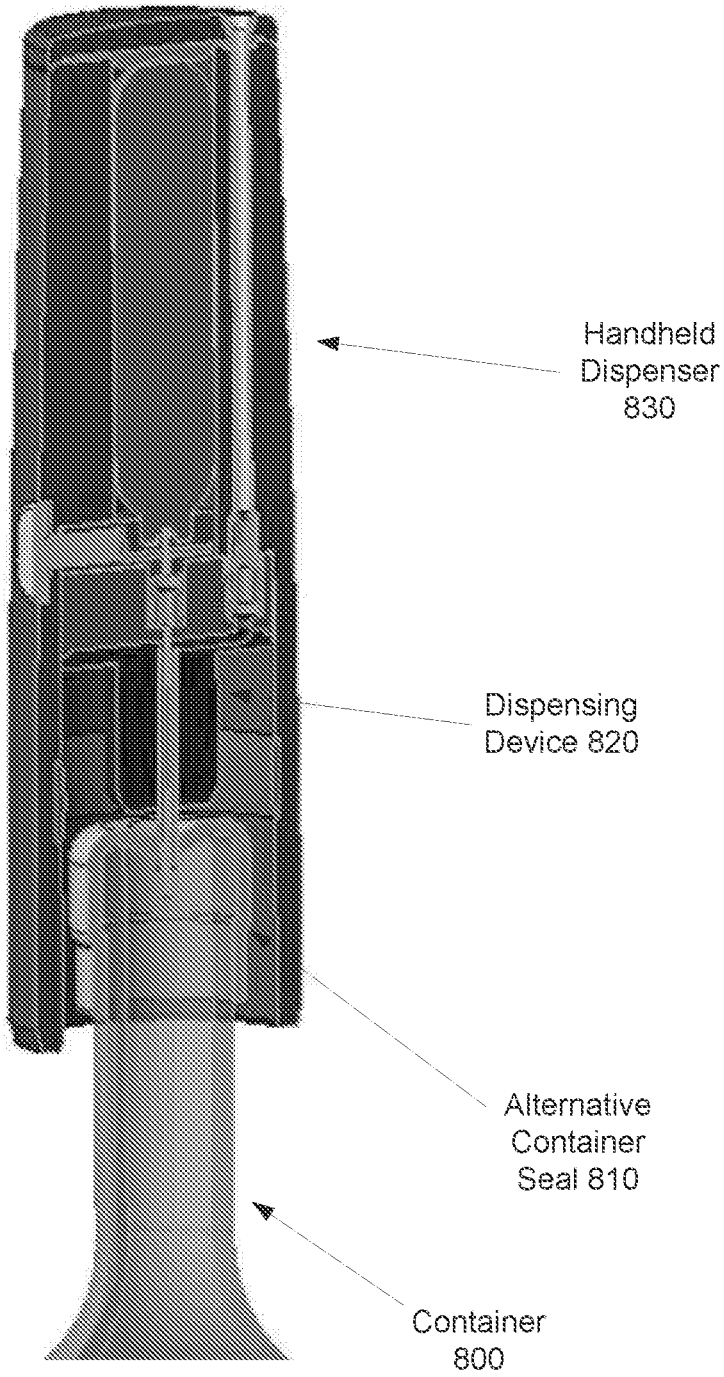
FIG. 8C shows a diagram of a container, an alternative container seal, a dispensing device, and a handheld dispenser in accordance with one or more embodiments of the invention with a portion of the container, the alternative container seal, the dispensing device, and the handheld dispenser removed.

While in FIGS. 6A-7E the appliance and handheld dispenser have been described as being used in conjunction with a container adapter to dispense fluids, embodiments of the invention are not so limited. The appliance and handheld dispenser may be used to dispense liquids from a container without use of a container adapter without departing from the invention. FIGS. 8A-8C illustrate embodiments of the invention where a handheld dispenser is used to dispense a liquid from a container without a container adapter. While not shown, the appliance may be similarly used.

FIG. 8A shows a diagram of a container (800) in accordance with one or more embodiments of the invention. The container (800) includes an alternative container seal (810). As used herein, an alternative container seal (810) refers to a seal that is not a cork or a metal cap. The alternative container seal (810) may be a physical device. The alternative container seal (810) may enable extraction elements of a dispensing device (e.g., 760, FIG. 7D) to be inserted into an interior of the container (800).

In one or more embodiments of the invention, when the extraction element of the dispensing device is inserted into the container via the alternative container seal (810), a seal between the alternative container seal (810) and the extraction element is formed and thereby prevents or reduces the likelihood of an ambient atmosphere or other material from entering the container.

In one or more embodiments of the invention, when the extraction element of the dispensing device is removed from the container via the alternative container seal (810), the alternative container seal (810) reseals the penetration point through the alternative container seal (810) through which the extraction element of the dispensing device was inserted. Thus, in some embodiments of the invention, the alternative container seal (810) may automatically reseal the container upon removal of the extraction element.

In one or more embodiments of the invention, the alternative container seal (810) is a cap disposed over an opening in the container (800). The alternative container seal (810) may isolate the interior of the container (800) from the ambient environment. The alternative container seal (810) may be a polymer or other pliable material. The alternative container seal (810) may be formed of other materials without departing from the invention.

FIG. 8B shows a diagram of the alternative container seal (810) and container (800) shown in FIG. 8A. In FIG. 8B, a portion of the alternative container seal (810) and the container (800) have been removed to illustrate internal portions of the aforementioned components. As seen from FIG. 8B, the container (800) includes only the alternative container seal (810). A traditional seal such as a cork or metal cap is not included in addition to the alternative container seal (810).

In one or more embodiments of the invention, the alternative container seal (810) is attached to the container (800)

at a bottling plant. For example, the alternative container seal (810) may be attached after a liquid is disposed in the container (800).

In one or more embodiments of the invention, the alternative container seal (810) is attached to the container (800) at a point of sale location. As used herein, a point of sale location refers to a location where goods are purchased by a consumer. The point of sale location may be, for example, a liquor store or a supermarket. In another example, the point of sale location may be a warehouse or other distribution center operated by a wholesaler. In the above scenario, a traditional seal such as a cork or metal cap may be removed and the alternative container seal (810) may be attached.

FIG. 8C shows a diagram of the alternative container seal (810) and container (800) shown in FIG. 8A and also includes a handheld dispenser (830) and a dispensing device (820). In FIG. 8B, a portion of the alternative container seal (810), the container (800), the handheld dispenser (830), and the dispensing device (820) have been removed to illustrate internal portions of the aforementioned components. The handheld dispenser (830) may be similar to the handheld dispenser illustrated in FIGS. 7A-7D and the dispensing device (820) may be similar to the dispensing device illustrated in FIGS. 5A-5B.

As seen from FIG. 8C, the dispensing device (820) may be attached to the handheld dispenser (830). An extraction element of the dispensing device (820) may penetrate the alternative container seal (810) and thereby enable liquid within the container to be dispensed by the handheld dispenser (830).

Figure 9:
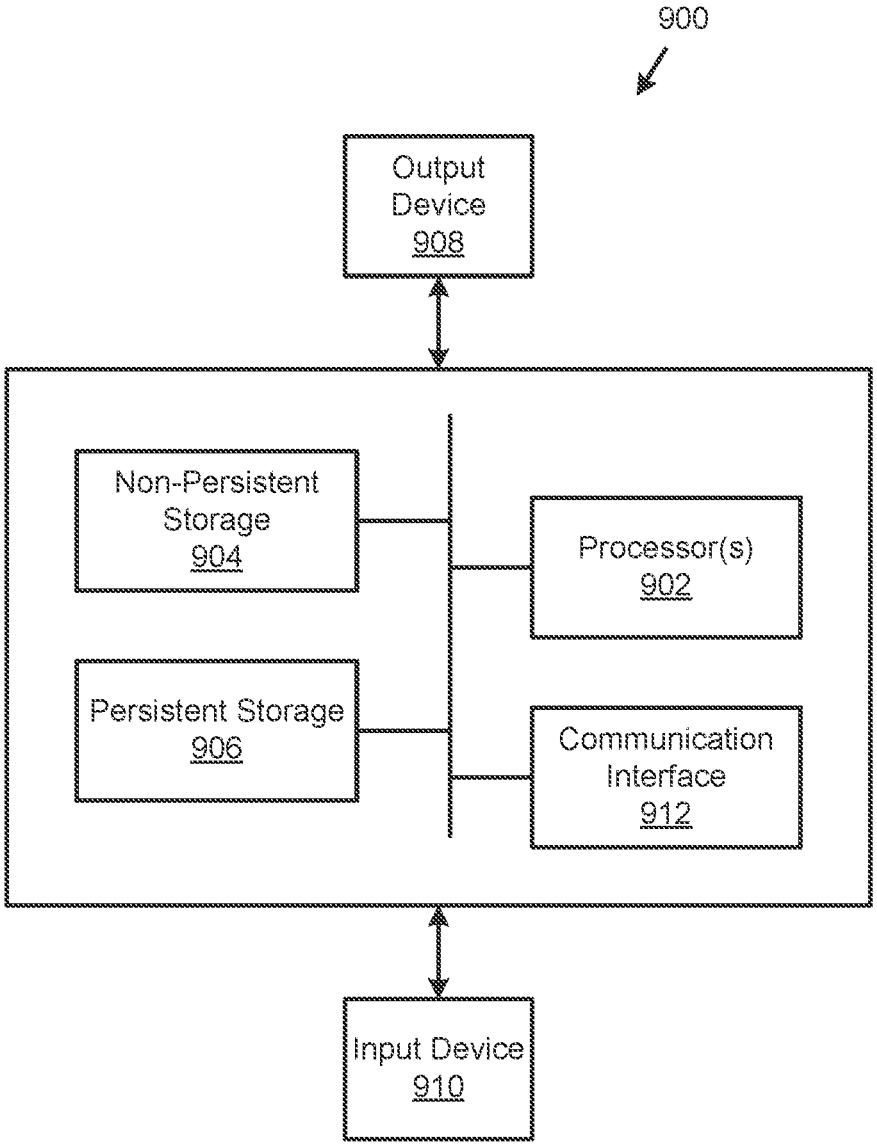
FIG. 9 shows a diagram of a computing device in accordance with one or more embodiments of the invention.

As discussed above, embodiments of the invention may be implemented using computing devices. For example, the appliance illustrated in FIGS. 6A-6E may include a computing device. FIG. 9 shows a diagram of a computing device in accordance with one or more embodiments of the invention. The computing device (900) may include one or more computer processors (902), non-persistent storage (904) (e.g., volatile memory, such as random access memory (RAM), cache memory), persistent storage (906) (e.g., a hard disk, an optical drive such as a compact disk (CD) drive or digital versatile disk (DVD) drive, a flash memory, etc.), a communication interface (912) (e.g., Bluetooth interface, infrared interface, network interface, optical interface, etc.), input devices (910), output devices (908), and numerous other elements (not shown) and functionalities. Each of these components is described below.

In one embodiment of the invention, the computer processor(s) (902) may be an integrated circuit for processing instructions. For example, the computer processor(s) may be one or more cores or micro-cores of a processor. The computing device (900) may also include one or more input devices (910), such as a touchscreen, keyboard, mouse, microphone, touchpad, electronic pen, or any other type of input device. Further, the communication interface (912) may include an integrated circuit for connecting the computing device (900) to a network (not shown) (e.g., a local area network (LAN), a wide area network (WAN) such as the Internet, mobile network, or any other type of network) and/or to another device, such as another computing device.

In one embodiment of the invention, the computing device (900) may include one or more output devices (908), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (902), non-persistent storage (904), and persistent storage (906). Many different types of computing devices exist, and the aforementioned input and output device(s) may take other forms.

One or more embodiments of the invention may enable one or more of the following: i) removal of a container seal while preserving/reducing contamination of a fluid in a container, ii) forming of a reversible seal on a container that enables fluid to be removed from the container while preserving/reducing contamination of the fluid remaining in the container, and iii) preservation/reducing contamination of a fluid disposed in a container after dispensing of a portion of the fluid from the container.

Further, a system in accordance with embodiments of invention may have several advantages when compared to contemporary systems. For example, the disclosed system may work with both a portable and appliance-based system interchangeably, thereby providing a more functional system. Further, with multiple containers prepared, a user may change what container/substance is being dispensed to an alternate container/substance while maintaining a seal system that preserves the liquid. Additionally, a system in accordance with embodiments of the invention may both (i) provide access to fluids in containers more quickly than contemporary systems and methods and (ii) enable containers to be resealed more quickly than contemporary systems. Such time savings in a commercial environment may be of great importance. Lastly, embodiments of the invention may (i) enable a bottle to be opened and resealed a larger number of times and (ii) eliminate or reduce container seal degradation issues found in contemporary approaches. Embodiments of the invention may provide these, and other, advantages by: (i) removing a container seal which is of limited value for multiple opening and resealing cycles due to its degradation susceptibility, (ii) replacing the container seal with a device in accordance with embodiments of the invention without introducing contaminants that may otherwise degrade the quality of the liquid included in the container, and (iii) providing access to the liquid in the container via the device that enables multiple opening and resealing cycles without degradation of the device or introducing contaminants into the liquid in the container during the multiple opening and resealing cycles.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A container adapter, comprising:

a first chamber adapted to attach to a container;

a second chamber comprising a sealing surface;

an attachment ring that attaches the first chamber to the container; and a resealable interface disposed between the first chamber and the second chamber, wherein the second chamber is exposed to an ambient environment, and wherein a seal between the container and the first chamber is formed when the first chamber is attached to the container.

2. The container adapter of claim 1, wherein the attachment ring is disposed on an exterior surface of the first chamber.

3. The container adapter of claim 1, wherein the attachment ring is adapted to:

move to a first position that attaches the first chamber to the container; and move to a second position that releases the container from the first chamber.

4. The container adapter of claim 1, wherein the resealable interface comprises an iris valve.

5. The container adapter of claim 1, wherein the resealable interface comprises a duckbill valve.

6. A container adapter, comprising:

a first chamber adapted to attach to a container;

a second chamber comprising a sealing surface; and a resealable interface disposed between the first chamber and the second chamber, wherein the second chamber is exposed to an ambient environment, and wherein the sealing surface creates a seal between a container seal of the container and the second chamber while the container seal is being removed from the first chamber via the second chamber.

7. A system, comprising:

a container adapter that is adapted to attach to a container, wherein the container adapter comprises:

a first chamber adapted to attach to a container, a second chamber comprising a sealing surface, wherein the sealing surface creates a seal between a container seal of the container and the second chamber while the container seal is being removed from the first chamber via the second chamber, and a resealable interface disposed between the first chamber and the second chamber, wherein the second chamber is exposed to an ambient environment; and a container seal remover that is adapted to remove the container seal while maintaining the seal between the container adapter and the container.

8. The system of claim 7, wherein the seal prevents air from the ambient environment from interacting with a fluid contained in the container while the container seal is removed.

9. The system of claim 8, wherein the seal prevents air from the ambient environment from interacting with a fluid contained in the container after the container seal is removed.

10. The system of claim 7, wherein the container seal remover is adapted to remove the container seal through the resealable interface of the container adapter.

11. The system of claim 10, wherein the container seal remover comprises:

a sealing surface that forms a second seal between the container seal remover and the container adapter.

12. The system of claim 11, wherein a sealed compartment is formed while the second seal is formed.

13. The system of claim 12, wherein the container seal remover further comprises:

an atmospheric regulator that regulates an atmosphere of the sealed compartment.

14. The system of claim 13, wherein the atmospheric regulator comprises:

a gas injector adapted to inject a gas in the sealed compartment.

15. The system of claim 13, wherein the atmospheric regulator comprises:

a receiver, hydraulically connected to the sealed compartment, adapted to receive a supply of a gas.

* * * * *